US011790857B2

(12) United States Patent
Kim et al.

(10) Patent No.: US 11,790,857 B2
(45) Date of Patent: Oct. 17, 2023

(54) DATA DRIVER AND DISPLAY DEVICE INCLUDING THE SAME

(71) Applicant: Samsung Display Co., LTD., Yongin-si (KR)

(72) Inventors: Soo Yeon Kim, Yongin-si (KR); Tae Gon Im, Yongin-si (KR); Jong Jae Lee, Yongin-si (KR); Dae Gwang Jang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/741,766

(22) Filed: May 11, 2022

(65) Prior Publication Data

US 2022/0415261 A1 Dec. 29, 2022

(30) Foreign Application Priority Data

Jun. 28, 2021 (KR) ..... 10-2021-0084314

(51) Int. Cl.
*G09G 3/3275* (2016.01)

(52) U.S. Cl.
CPC ... *G09G 3/3275* (2013.01); *G09G 2310/0291* (2013.01); *G09G 2310/0297* (2013.01); *G09G 2310/08* (2013.01)

(58) Field of Classification Search
CPC ..... G09G 3/3275; G09G 2310/0291; G09G 2310/0297; G09G 2310/08
See application file for complete search history.

(56) References Cited

U.S. PATENT DOCUMENTS

| | | | | |
|---|---|---|---|---|
| 10,269,301 | B2 * | 4/2019 | Kishi | G09G 3/3291 |
| 10,403,196 | B2 * | 9/2019 | Shin | G09G 3/20 |
| 10,685,617 | B2 * | 6/2020 | Im | G09G 3/3688 |
| 10,832,606 | B2 * | 11/2020 | Kim | G09G 3/006 |
| 10,847,070 | B2 * | 11/2020 | Lee | G09G 3/3674 |
| 10,902,816 | B2 * | 1/2021 | Liu | G09G 3/20 |
| 10,964,287 | B1 * | 3/2021 | Tsuchi | G09G 3/3688 |
| 11,164,532 | B2 * | 11/2021 | Kwon | G09G 3/3266 |
| 11,200,864 | B2 * | 12/2021 | Tsuchi | G09G 3/3688 |
| 11,302,236 | B2 * | 4/2022 | Pyun | G09G 3/2011 |
| 11,508,274 | B2 * | 11/2022 | Choi | G09G 3/3696 |
| 2008/0266276 | A1 | 10/2008 | Choi et al. | |
| 2010/0214277 | A1 * | 8/2010 | Yamazaki | G09G 3/3688 345/87 |
| 2011/0050677 | A1 | 3/2011 | Tsai et al. | |
| 2012/0038599 | A1 * | 2/2012 | Shiu | G09G 3/3688 345/204 |
| 2013/0135129 | A1 * | 5/2013 | Chang | G06F 3/041 341/172 |

(Continued)

*Primary Examiner* — Michael J Jansen, II
(74) *Attorney, Agent, or Firm* — KILE PARK REED & HOUTTEMAN PLLC

(57) ABSTRACT

A display device includes a display panel including data lines and pixels electrically connected to the data lines. The data driver supplies data signals to the data lines. The data driver includes: a first output buffer electrically connected to a first data line of the data lines, the first output buffer outputting a first data signal to the first data line; and a first comparator electrically connected to an output terminal of the first output buffer, the first comparator comparing a first slew rate of the first data signal with a first reference slew rate.

20 Claims, 12 Drawing Sheets

(56) References Cited

U.S. PATENT DOCUMENTS

| | | | | |
|---|---|---|---|---|
| 2015/0279297 | A1* | 10/2015 | Nakano | G06F 3/0446 345/94 |
| 2016/0379548 | A1* | 12/2016 | Shin | G09G 3/2096 345/214 |
| 2018/0061328 | A1* | 3/2018 | Kishi | G09G 3/3266 |
| 2018/0293955 | A1* | 10/2018 | Liu | H03K 19/0175 |
| 2018/0313883 | A1* | 11/2018 | Wu | G01R 31/52 |
| 2019/0066621 | A1* | 2/2019 | Im | G09G 3/3688 |
| 2019/0096300 | A1 | 3/2019 | Lin et al. | |
| 2019/0156716 | A1* | 5/2019 | Kim | G09G 3/20 |
| 2019/0204981 | A1 | 7/2019 | Lee et al. | |
| 2019/0340966 | A1* | 11/2019 | Lee | G09G 3/006 |
| 2020/0394968 | A1* | 12/2020 | Kwon | G09G 3/3291 |
| 2021/0090519 | A1* | 3/2021 | Tsuchi | G09G 3/3688 |
| 2021/0217377 | A1* | 7/2021 | Tsuchi | H03K 3/0233 |
| 2021/0407349 | A1* | 12/2021 | Choi | G09G 3/006 |
| 2022/0084453 | A1* | 3/2022 | Pyun | G09G 3/2011 |
| 2022/0230578 | A1* | 7/2022 | Pyun | G09G 3/2011 |
| 2022/0351661 | A1* | 11/2022 | Choi | G09G 3/20 |
| 2022/0415261 | A1* | 12/2022 | Kim | G09G 3/3275 |

* cited by examiner

DATA DRIVER AND DISPLAY DEVICE INCLUDING THE SAME

CROSS-REFERENCE TO RELATED APPLICATION(S)

The present application claims priority to and benefits of Korean patent application 10-2021-0084314 under 35 U.S.C. § 119, filed in the Korean Intellectual Property Office on Jun. 28, 2021, the entire contents of which are incorporated herein by reference.

BACKGROUND

1. Technical Field

The disclosure generally relates to a data driver and a display device including the same, which is capable of monitoring a contact resistance between the data driver and a display panel.

2. Description of Related Art

Recently, as interest in information displays is increased, research and development of display devices have been continuously conducted.

A non-display area (or bezel area) of a display panel has recently minimized, and accordingly, there may occur a defect in bonding between the display panel and a data driver in the non-display area (e.g., an increase in contact resistance between a data line of the display panel and the data driver). A data signal may not be normally provided to the display panel due to the defect in the bonding between the display panel and the data driver, and the display quality of an image displayed on the display panel may be deteriorated.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

Embodiments provide a data driver and a display device, which is capable of monitoring a contact resistance between a data driver and a display panel.

In accordance with an aspect of the disclosure, there is provided a display device including a display panel including data lines and pixels electrically connected to the data lines; and a data driver that supplies data signals to the data lines, wherein the data driver includes a first output buffer electrically connected to a first data line of the data lines, the first output buffer outputting a first data signal to the first data line; and a first comparator electrically connected to an output terminal of the first output buffer, the first comparator comparing a first slew rate of the first data signal with a first reference slew rate.

The first slew rate of the first data signal may be changed according to a resistance between the first output buffer and the first data line.

The display device may further include a controller that determines whether the resistance is within a normal range based on a comparison result of the first comparator.

The first data signal may be a square wave having a first voltage level or a second voltage level. The first comparator may determine a transition time from the first voltage level to the second voltage level as the first slew rate of the first data signal.

The first comparator may include a first counter that calculates the transition time based on a reference clock signal; and a digital comparator that compares an output of the first counter with a reference transition time corresponding to the first reference slew rate.

The data driver may further include a second output buffer electrically connected to a second data line of the data lines, the second output buffer outputting a second data signal to the second data line; and a multiplexer that selectively transfers an output of the output terminal of the first output buffer and an output of an output terminal of the second output buffer to the first comparator.

In a first period, the multiplexer may transfer the output of the output terminal of the first output buffer to the first comparator, and the first comparator may output a first comparison result corresponding to a first resistance between the first output buffer and the first data line. In a second period, the multiplexer may transfer the output of the output terminal of the second output buffer to the first comparator, and the first comparator may output a second comparison result corresponding to a second resistance between the second output buffer and the second data line.

The data driver may further include a second output buffer electrically connected to a second data line of the data lines, the second output buffer outputting a second data signal to the second data line; a second comparator; and a multiplexer that transfers an output of the output terminal of the first output buffer to the first comparator, and transfers an output of the second output buffer to the second comparator. The second comparator may compare a second slew rate of the second data signal with a second reference slew rate.

The second reference slew rate may be different from the first reference slew rate.

The data driver may further include a third output buffer electrically connected to a third data line of the data lines, the third output buffer outputting a third data signal to the third data line; a fourth output buffer electrically connected to a fourth data line of the data lines, the fourth output buffer outputting a fourth data signal to the fourth data line; and a switching part that electrically connects the first output buffer or the third output buffer to the multiplexer, and electrically connects the second output buffer or the fourth output buffer to the multiplexer.

With respect to one or more pixels in a same row among the pixels, a first output timing at which the first output buffer outputs the first data signal may be equal to a second output timing at which the second output buffer outputs the second data signal, and a third output timing at which the third output buffer outputs the third data signal may be different from the first output timing of the first output buffer.

In accordance with another aspect of the disclosure, there is provided a display device including a display panel including data lines and pixels electrically connected to the data lines; and a data driver that supplies data signals to the data lines, wherein the data driver includes a plurality of data driver ICs (integrated circuits), and wherein each of the plurality of data driver ICs includes output buffers, each of the output buffers outputting a data signal to a corresponding data line among the data lines; a comparator that compares a slew rate of a signal provided to an input terminal thereof with a reference slew rate; and a multiplexer electrically connected between the output buffers and the comparator, the multiplexer sequentially providing data signals output from the output buffers to the comparator.

The display device may further include a timing controller electrically connected to the plurality of data driver ICs through a feedback line. The comparator may generate a feedback signal by comparing the slew rate of the signal with the reference slew rate. The plurality of data driver ICs may sequentially provide the feedback signal to the timing controller through the feedback line.

The slew rate may be changed according to a resistance between an output buffer outputting the signal among the output buffers and a corresponding data line among the data lines.

The timing controller may determine whether the resistance of each of the data lines is within a normal range based on a time at which the feedback signal is received.

In accordance with still another aspect of the disclosure, there is provided a data driver including a digital-analog converter that generates a first data signal corresponding to grayscale values of image data; a first output buffer that outputs the first data signal to the outside; and a first comparator electrically connected to an output terminal of the first output buffer, the first comparator comparing a first slew rate of the first data signal with a first reference slew rate.

The first data signal may be a square wave having a first voltage level or a second voltage level. The first comparator may determine a transition time from the first voltage level to the second voltage level as the first slew rate of the first data signal.

The first comparator may include a first counter that calculates the transition time based on a reference clock signal; and a digital comparator that compares an output of the first counter with a reference transition time corresponding to the first reference slew rate.

The data driver may further include a second output buffer that outputs a second data signal generated by the digital-analog converter to the outside; and a multiplexer that selectively transfers an output of the output terminal of the first output buffer and an output of an output terminal of the second output buffer to the first comparator.

In a first period, the multiplexer may transfer an output of the output terminal of the first output buffer to the first comparator, and the first comparator may output a first comparison result corresponding to the first output buffer. In a second period, the multiplexer may transfer an output of the output terminal of the second output buffer to the first comparator, and the first comparator may output a second comparison result corresponding to the second output buffer.

BRIEF DESCRIPTION OF THE DRAWINGS

An additional appreciation according to the embodiments of the invention will become more apparent by describing in detail the embodiments thereof with reference to the accompanying drawings, wherein.

DETAILED DESCRIPTION OF THE EMBODIMENTS

Figure 1:
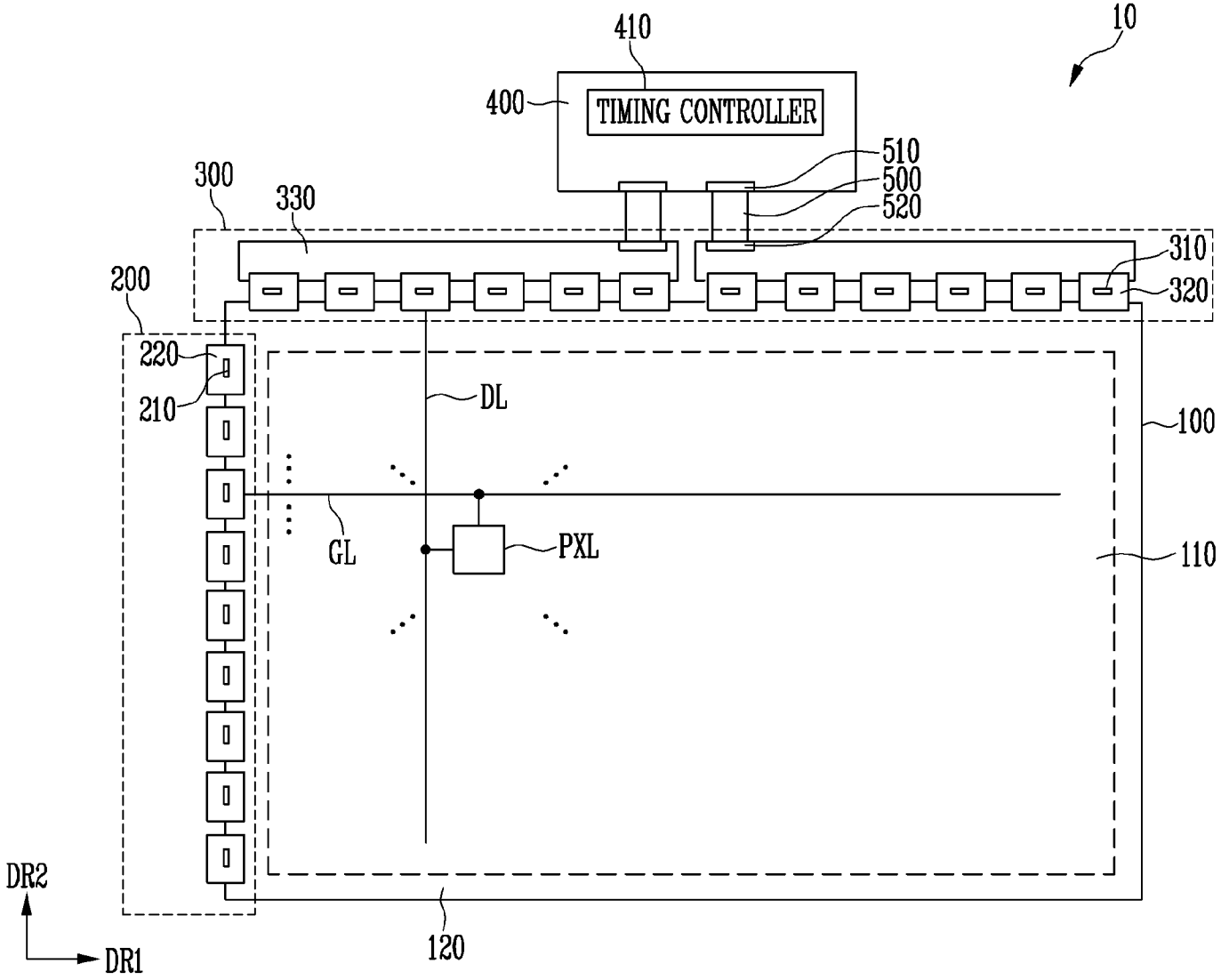
FIG. 1 is a schematic diagram illustrating a display device in accordance with embodiments of the disclosure.

Embodiments of the invention will be described hereinafter with reference to the accompanying drawings. Although the embodiments may be modified in various manners and have additional embodiments, embodiments are illustrated in the accompanying drawings and will be mainly described in the specification. However, the scope of the disclosure is not limited to the embodiments in the accompanying drawings and the specification and should be construed as including all the changes, equivalents and substitutions included in the spirit and scope of the disclosure.

Some of the parts which are not associated with the description may not be provided in order to describe embodiments of the invention and line reference numerals refer to like elements throughout the specification.

In the drawings, sizes and thickness of lines, layers, components, elements or features may be enlarged for clarity and ease of description thereof. However, the disclosure is not limited to the illustrated sizes and thicknesses. In the drawings, the thicknesses of lines, layers, films, panels, regions, and other elements may be exaggerated for clarity. In the drawings, for better understanding and ease of description, the thicknesses of some layers and areas may be exaggerated.

Further, in the specification, the phrase "in a plan view" means when an object portion is viewed from above, and the phrase "in a cross-sectional view" means when a cross-section taken by vertically cutting an object portion is viewed from the side.

When a layer, film, region, substrate, or area, is referred to as being "on" another layer, film, region, substrate, or area, it may be directly on the other film, region, substrate, or area, or intervening films, regions, substrates, or areas, may be present therebetween. Conversely, when a layer, film, region, substrate, or area, is referred to as being "directly on" another layer, film, region, substrate, or area, intervening layers, films, regions, substrates, or areas, may be absent therebetween. Further when a layer, film, region, substrate, or area, is referred to as being "below" another layer, film, region, substrate, or area, it may be directly below the other layer, film, region, substrate, or area, or intervening layers, films, regions, substrates, or areas, may be present therebetween. Conversely, when a layer, film, region, substrate, or area, is referred to as being "directly below" another layer, film, region, substrate, or area, intervening layers, films, regions, substrates, or areas, may be absent therebetween. Further, "over" or "on" may include positioning on or below an object and does not necessarily imply a direction based upon gravity.

It will be understood that, although the terms "first", "second", or the like may be used herein to describe various elements, these elements should not be limited by these terms. These terms are only used to distinguish one element from another element. Thus, a "first" element discussed below could also be termed a "second" element without departing from the teachings of the present disclosure. As used herein, the singular forms are intended to include the plural meanings as well, unless the context clearly indicates otherwise.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

It will be further understood that the terms "comprises", "comprising", "includes" and/or "including", when used in this specification, specify the presence of stated features, integers, steps, operations, elements, and/or components, but do not preclude the presence and/or addition of one or more other features, integers, steps, operations, elements, components, and/or groups thereof.

Throughout the specification, when an element is referred to as being "connected" or "coupled" to another element, it can be "directly connected" or "directly coupled" to the another element or "electrically connected" or "electrically coupled" to another element with one or more intervening elements interposed therebetween.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 80%, 5% of the stated value.

Some embodiments are described in the accompanying drawings in relation to functional blocks, units, and/or modules. Those skilled in the art will understand that these blocks, units, and/or modules are physically implemented by logic circuits, individual components, microprocessors, hard wire circuits, memory elements, line connection, and other electronic circuits. This may be formed by using semiconductor-based manufacturing techniques or other manufacturing techniques. In the case of blocks, units, and/or modules implemented by microprocessors or other similar hardware, the units, and/or modules are programmed and controlled by using software, to perform various functions discussed in the disclosure, and may be selectively driven by firmware and/or software. In addition, each block, each unit, and/or each module may be implemented by dedicated hardware or by a combination dedicated hardware to perform some functions of the block, the unit, and/or the module and a processor (e.g., one or more programmed microprocessors and associated circuitry) to perform other functions of the block, the unit, and/or the module. In some embodiments, the blocks, the units, and/or the modules may be physically separated into two or more individual blocks, two or more individual units, and/or two or more individual modules without departing from the scope of the disclosure. Also, in some embodiments, the blocks, the units, and/or the modules may be physically separated into more complex blocks, more complex units, and/or more complex modules without departing from the scope of the disclosure.

In the specification and the claims, the phrase "at least one of" is intended to include the meaning of "at least one selected from the group of" for the purpose of its meaning and interpretation. For example, "at least one of A and B" may be understood to mean "A, B, or A and B."

In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or."

Unless otherwise defined or implied herein, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

FIG. 1 is a schematic diagram illustrating a display device in accordance with embodiments of the disclosure. In FIG. 1, a display device having gate driver ICs and data driver ICs is illustrated as one of embodiments to which the disclosure may be applied. However, the disclosure is not limited thereto. For example, the disclosure may also be applied to a display device including one gate driver IC and one data driver IC.

Referring to FIG. 1, the display device 10 may include a display panel 100 (e.g., display part or pixel part), a gate driver 200, a data driver 300 (or source driver), and a timing controller 410. The gate driver 200 may include a gate driver integrated circuit 210 (hereinafter, referred to as a gate driver "IC" or gate driving circuit), and the data driver 300 may include a data driver IC 310 (hereinafter, referred to as a source driver IC or data driving circuit).

The display panel 100 may include a display area 110 in which an image is displayed and a non-display area 120 disposed at the periphery of the display area 110. For example, the non-display area 120 may surround the display area 110. The display panel 100 may include gate lines GL, data lines DL, and pixels PXL.

The gate lines GL may extend in a second direction DR2, and be arranged along a first direction DR1. The data lines DL may extend in the first direction DR1, and be arranged along the second direction DR2. Each pixel PXL may be located in an area in which a gate line GL and a data line DL intersect each other, or be located in an area partitioned or defined by the gate line GL and the data line DL. The pixel PXL may be connected to the gate line GL and the data line DL, and emit light with a luminance corresponding a data signal (or data voltage) in response to a gate signal. For example, each pixel PXL may be electrically connected to one of the gate lines GL and one of the data lines DL. The gate signal may be provided to the pixel PXL through the gate line GL, and the data signal may be provided to the pixel PXL through the data line DL. For example, the pixel PXL may include at least one light emitting element, a switching transistor which transfers a data signal in response to a gate signal, a storage capacitor which stores the data signal transferred through the switching transistor, and a driving transistor which provides a driving current to the at least one light emitting element, corresponding to the stored data signal. The light emitting element may be configured as or implemented with, for example, an organic light emitting diode or an inorganic light emitting diode, and the inorganic light emitting diode may include a micro light emitting diode, a quantum dot light emitting diode, or other suitable inorganic light emitting diodes. Also, the light emitting element may be configured with or implemented with, for example, a combination of an organic material and an inorganic material. In case that the pixel PXL includes multiple light emitting elements, the light emitting elements may be electrically connected in series, parallel, or series/parallel to each other.

The timing controller 410 may control at least one gate driver IC 210 and at least one data driver IC 310. The timing controller 410 may receive a control signal from the outside, and generate a gate control signal and a data control signal based on the control signal. The control signal may include at least one of a vertical synchronization signal, a horizontal synchronization signal, an external clock signal, and the like. The timing controller 410 may provide the gate control signal to the gate driver IC 210, and provide the data control signal to the data driver IC 310.

Also, the timing controller 410 may generate image data by realigning input data (or original image data) provided from the outside (e.g., graphic processor), and provide the image data to the data driver IC 310. The timing controller 410 may be mounted on a control board 400.

The gate driver IC 210 and the data driver IC 310 may drive the display panel 100.

The gate driver IC 210 may receive the gate control signal from the timing controller 410, generate gate signals based on the gate control signal, and provide the gate signals to the display panel 100. The gate control signal may include a start pulse and a clock signal (e.g., a scan clock signal and a carry clock signal). The gate driver IC 210 may generate a gate signal corresponding to the start pulse by using the clock signal, and provide the gate signal to the gate line GL. For example, the gate driver IC 210 may be implemented as, for example, a shift register which sequentially shifts and outputs the start pulse.

The gate driver IC 210 may be mounted on a gate drive circuit film 220, and may be electrically connected to the timing controller 410 mounted on the control board 400 via at least one data drive circuit film 320 (e.g., source drive circuit film or flexible circuit board), a data printed circuit board 330 (or source printed circuit board), and/or a cable 500 (or flexible circuit board). However, the disclosure is not limited thereto. For example, the gate driver IC 210 may be formed together with the pixel PXL on the display panel 100. Also, the gate driver ICs 210 may be distributed and disposed between adjacent ones of the pixels PXL in the display area 110.

The data driver IC 310 may receive the data control signal and image data from the timing controller 410, and generate a data signal corresponding to the image data. The data driver IC 310 may provide a data signal to the display panel 100. A more detailed configuration of the data driver IC 310 will be described below with reference to FIG. 2. The data driver IC 310 may be mounted on the data drive circuit film 320, and be electrically connected to the timing controller 410 via at least one data printed circuit board 330 and/or the cable 500.

In an embodiment, the data driver IC 310 may measure or calculate a slew rate of a data signal provided to the data line DL or a slew rate of a channel of the data driver IC 310, through which the data signal is output. For example, in a slew rate test mode (i.e., a mode or period allocated to measure a slew rate), the data driver IC 310 may measure or calculate a slew rate of a data signal provided to the data line DL. The slew rate may mean a ratio at which an output signal (i.e., a data signal) follows an input signal. In case that a data signal has a first level and a second level, the slew rate may be defined or expressed as a time (e.g., period) for which the data signal is changed from the first level to the second level, i.e., a transition time (e.g., transition period). For example, the first level may have a voltage level corresponding to one of a first grayscale (e.g., a minimum grayscale corresponding to a black color, i.e., a grayscale value of 0) and a second grayscale (e.g., a maximum grayscale value corresponding to a white color, i.e., a grayscale value of 255), and the second level may have a voltage level corresponding to the other of the first grayscale and the second grayscale. The slew rate of the data signal may be changed according to a contact resistance between the data driver IC 310 and the data line DL. For example, the contact resistance may be a bonding resistance (e.g., an outer lead bonding (OLB) resistance) between the data drive circuit film 320 on which the data driver IC 310 is mounted and the display panel 100. For example, the slew rate may be increased or become faster as the contact resistance is increased or becomes larger.

Also, the data driver IC 310 may compare the slew rate of the data signal with a reference slew rate (or reference value). A comparison result (or feedback signal) may be provided to the timing controller 410. The reference slew rate may have a predetermined slew rate value by considering (or determined by) a normal contact resistance. For example, in case that the slew rate of the data signal is equal or similar to the reference slew rate or in case that the slew rate of the data signal belongs to an error allow range with respect to the reference slew rate, the data driver IC 310 may output a comparison result having a first value (e.g., a value of 1 or a logic high level). For example, the data driver IC 310 may output the comparison result having the first value in case that the slew rate of the data signal is within the error allow range. For example, in case that the slew rate of the data signal is different from the reference slew rate or in case that the slew rate of the data signal is out of the error allow range with respect to the reference slew rate, the data driver IC 310 may output a comparison result having a second value (e.g., value of 0 or logic low level). For example, the data driver IC 310 may output the comparison result having the second value in case that the slew rate of the data signal is out of the error allow range. For example, based on the comparison result, it may be determined whether a contact resistance with respect to a corresponding data line DL (or corresponding channel of data driver IC 310) is normal (or within a normal range). Also, the data driver IC 310 may measure a slew rate with respect to each of data lines DL, to determine whether a contact resistance with respect to each of the data lines DL is normal. For example, the contact resistance with respect to each of the data lines DL may be monitored.

In case that the display panel 100 includes multiple data lines DL, the data driver IC 310 may sequentially output comparison results with respect to the data lines DL. Thus, a data line (or channel), a contact resistance of which is abnormal, among the data lines (or channels of the data driver IC 310) may be identified.

The cable 500 may electrically connect the control board 400 and at least one data printed circuit board 330 to each other through upper and lower connectors 510 and 520. The cable 500 inclusively means a device having a line capable of electrically connecting the control board 400, the data printed circuit board 330, and the like. For example, the cable 500 may be implemented as a flexible circuit board.

As described above, by virtue of the data driver IC 310, the display device 10 measures a slew rate of a data signal, compares the slew rate of the data signal with the reference slew rate, and determines whether a contact resistance with respect to a corresponding data line is normal, based on a comparison result. For example, a portion (e.g., a channel), a contact resistance of which is abnormal, may be readily detected. The quality of an image displayed on the display panel may be improved through repair of the portion (e.g., a portion corresponding to the channel among portions at which the data drive circuit film 320 and the display panel 100 are bonded to each other) or compensation for the corresponding data signal.

Figure 2:
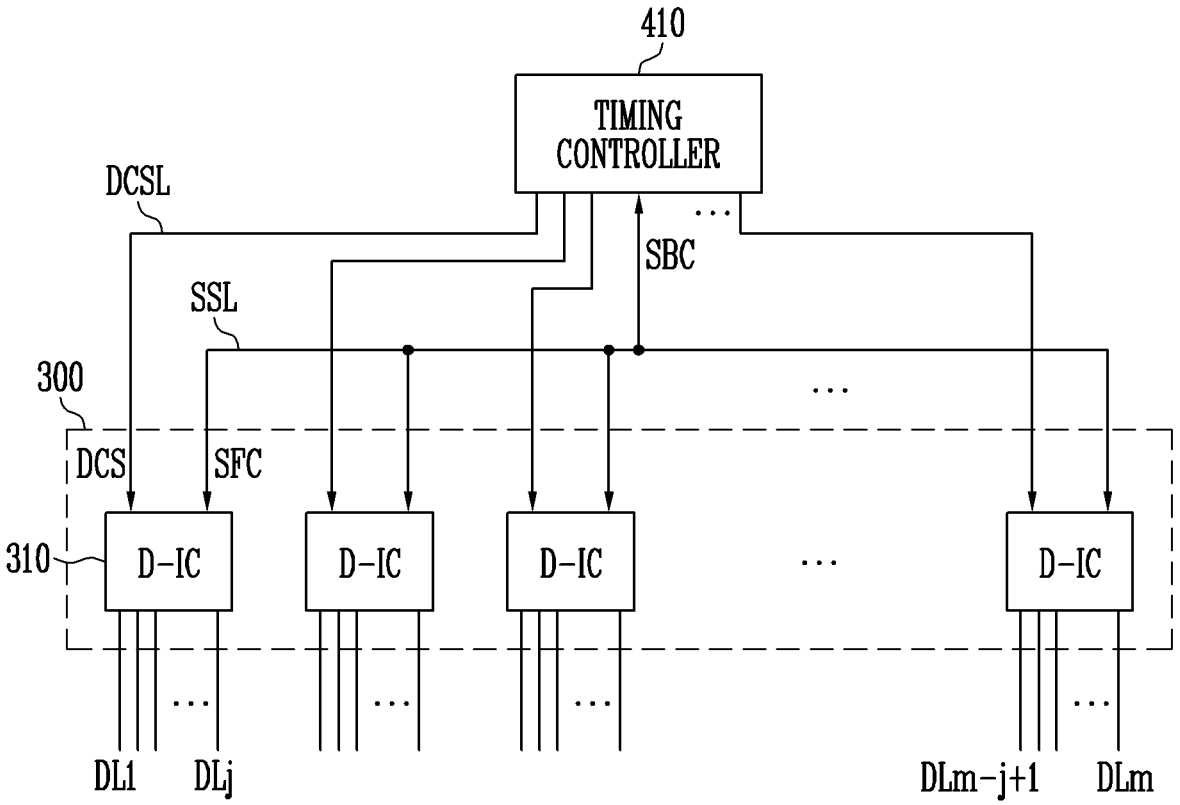
FIG. 2 is a schematic diagram illustrating an embodiment of signal lines connecting a timing controller and a data driver IC of the display device shown in FIG. 1.

FIG. 2 is a schematic diagram illustrating an embodiment of signal lines connecting the timing controller and the data driver IC of the display device shown in FIG. 1.

Referring to FIGS. 1 and 2, the data driver 300 may include data driver ICs 310. Each of the data driver ICs 310 may be referred to as a driver IC (D-IC) or a source IC.

Each of the data driver ICs 310 may be electrically connected to at least one data line among data lines DL1 to DLm (m is a positive integer). For example, in case that the data driver 300 includes only one data driver IC 310, the data driver IC 310 may be identical to the data driver 300. The data lines DL1 to DLm may be electrically connected to the one data driver IC 310. In another example, in case that the data driver 300 includes multiple data driver ICs 310, the data lines DL1 to DLm may be grouped into data line groups, and each data line group may be electrically connected to a corresponding data driver IC 310. For example, each of the data line groups may include j data lines (j is a positive integer), and each of the data driver ICs 310 may be electrically connected to j data lines of each of the data line group. For example, j may be 960, 320, or the like. For example, a first data driver IC 310 may be electrically connected to a first data line DL1 to a jth data line DLj, and a last data driver IC 310 may be electrically connected to an (m−j+1)th data line DLm−j+1 to an mth data line DLm. For example, m may be 7,680 with respect to a resolution of 8 k, and the data driver 300 may include 24 data driver ICs 310.

The timing controller 410 and the data driver 300 may be electrically connected to each other through a data clock signal line DCSL and a sharing signal line SSL (or feedback line).

The timing controller 410 may be electrically connected to the data driver ICs 310 through the data clock signal line DCSL. For example, a method in which the timing controller 410 is connected to the data driver ICs 310 through the data clock signal line DCSL may be a point-to-point method. The data clock signal line DCSL may include multiple sub-data clock signal lines corresponding to the number of the data driver ICs 310. For example, the number of the sub-data clock signal lines may be equal to the number of the data driver ICs 310. However, the disclosure is not limited thereto. Accordingly, the timing controller 410 may be electrically connected to the data driver ICs 310 through the sub-data color signal lines, respectively.

The data clock signal line DCSL may be implemented as (or may be correspond to), for example, an interface (e.g., USI or USI-T) for transmitting a data control signal DCS to the data driver 300 (or data driver ICs 310) from the timing controller 410. The data control signal DCS may be data in which a clock signal is embedded. For example, the data control signal DCS may include a clock training signal and image data. Since the timing controller 410 and the data driver ICs 310 are electrically connected to each other through the data clock signal line DCSL, the timing controller 410 may provide a data control signal DCS corresponding to each of the data driver ICs 310 through the data clock signal line DCSL.

The timing controller 410 may commonly connected to the data driver ICs 310 of the data driver 300 through the sharing signal line SSL. For example, one timing controller 410 may be electrically connected to all the data driver ICs 310 of the data driver 300 through the sharing signal line SSL. However, the disclosure is not limited thereto. For example, a method in which the timing controller 410 is electrically connected to the data driver ICs 310 of the data driver 300 through the sharing signal line SSL may be a multi-drop method.

The sharing signal line SSL may be implemented as a bidirectional signal transmission channel formed between the timing controller 410 and the data driver 300 (or data driver ICs 310). The sharing signal line SSL may be implemented as, for example, a signal transmission channel for transmitting a first control signal SFC (e.g., clock training notification signal) provided from the timing controller 410 to the data driver 300 (or data driver ICs 310) and a second control signal SBC (e.g., a feedback signal including a comparison result) provided from the data driver 300 (or data driver ICs 310) to the timing controller 410. For example, the timing controller 410 may supply the first control signal SFC having a first level (or logic low level) to the data driver 300 through the sharing signal line SSL to notify the application of a clock training signal. The data driver 300 may supply the second control signal SBC representing a reception state of the data driver 300 to the timing controller 410 through the sharing signal line SSL identical to the transmission channel of the first control signal SFC.

In an embodiment, each of the data driver ICs 310 may provide the timing controller 410 with a feedback signal including a comparison result (e.g., second control signal SBC) through the sharing signal line SSL. The comparison result may be a comparison result between a slew rate of a data signal with respect to each of the data lines DL1 to DLm and the reference slew rate.

Since the comparison result is transmitted through one sharing signal line SSL, the data driver ICs 310 may sequentially output comparison results with respect to the data lines DL1 to DLm. For example, the data driver ICs 310 may sequentially output the comparison results from a first comparison result with respect to the first data line DL1 to an mth comparison result with respect to the mth data line DLm in at least one horizontal time unit (e.g., one horizontal period). For example, the data driver ICs 310 may sequentially comparison results in a frame unit. For example, a first data driver IC 310 outputs comparison results in a first frame, and may sequentially output the comparison results from a first comparison result with respect to the first data line DL1 to a jth comparison result with respect to the jth data line DLj. Similarly, the last data driver IC 310 outputs an (m or j)th comparison result in an (m or j)th frame (or last frame), and may sequentially output the comparison results from a (m−j+1)th comparison result with respect to the (m−j+1)th data line DLm−j+1 to an mth comparison result with respect to the mth data line DLm.

For example, the data driver 300 may provide the timing controller 410 with the comparison result (or feedback signal including comparison result) through the sharing signal line SSL by using a time division method. Thus, a separate interface (or channel) (not illustrated) for transmitting the comparison results with respect to the data lines DL1 to DLm may be omitted, and accordingly, manufacturing cost of the display device 10 (refer to FIG. 1) may be reduced.

Figure 3:
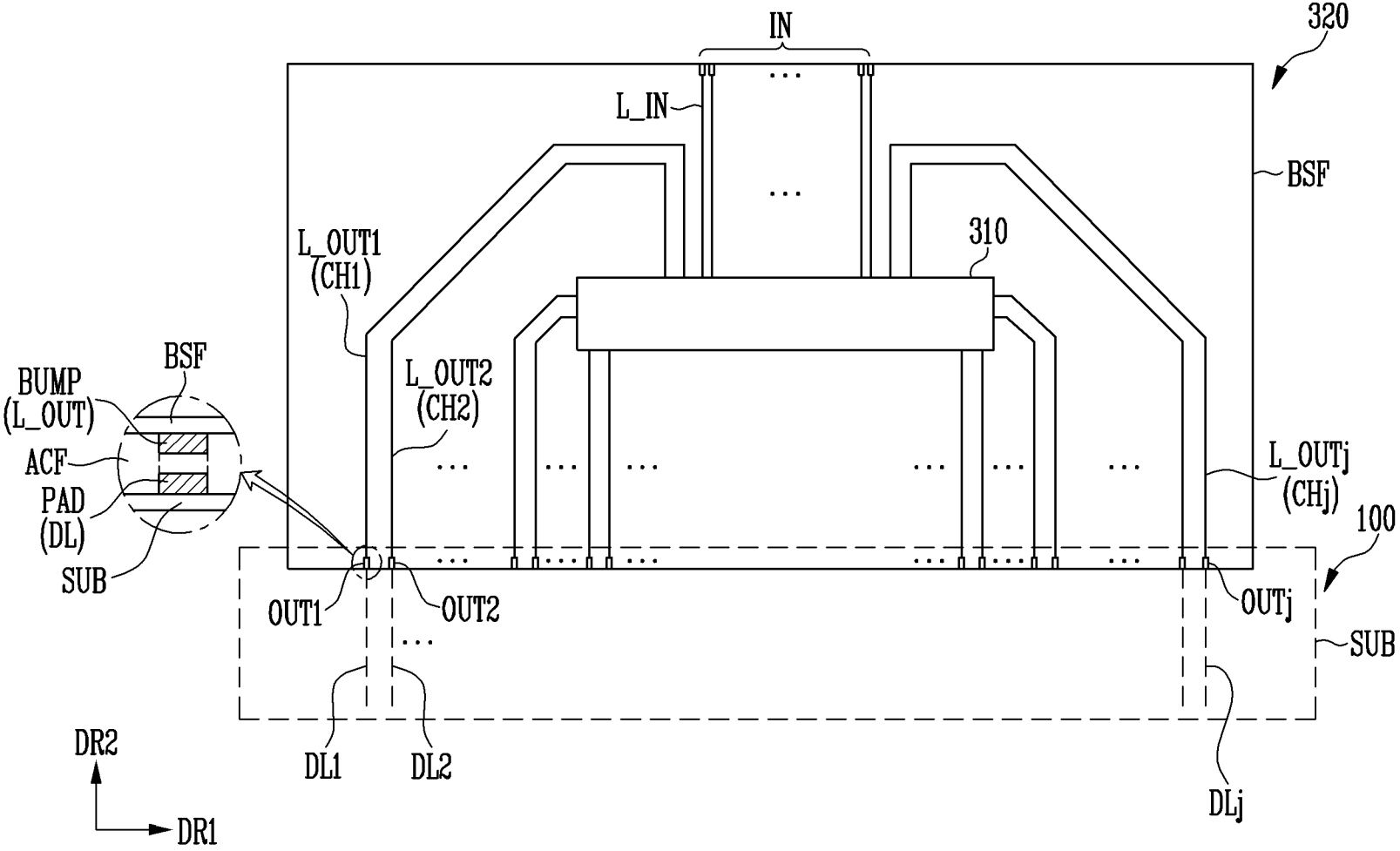
FIG. 3 is a schematic diagram illustrating a connection relationship between the data driver IC and a display panel of the display device shown in FIG. 1.

FIG. 3 is a schematic diagram illustrating a connection relationship between the data driver IC and the display panel of the display device shown in FIG. 1.

Referring to FIGS. 1 and 3, the data drive circuit film 320 may include a base film BSF, input terminals IN, input lines L_IN, output lines L_OUT1 to L_OUTj (or channels CH1 to CHj), and output terminals OUT1 to OUTj (or bump BUMP).

The base film BSF may be a flexible substrate. The data driver IC 310 may be mounted in one area (e.g., central area) of the base film BSF.

The input terminals IN may be disposed at one side (e.g., upper side) of the base film BSF, be connected (e.g. directly connected) to the data printed circuit board 330 described with reference to FIG. 1, and be electrically connected to the timing controller 410 (see FIG. 1) through lines of the data printed circuit board 330.

The input lines L_IN may extend from the input terminals IN to an area in which the data driver IC 310 is mounted. The input lines L_IN may electrically connect the input terminals IN to the data driver IC 310. The input lines L_IN may transmit the data control signal and image data to the data driver IC 310 from the timing controller 410 (see FIG. 1).

The output lines L_OUT1 to L_OUTj may respectively extend to the output terminals OUT1 to OUTj from the area in which the data driver IC 310 is mounted. The output lines L_OUT1 to L_OUTj may electrically connect the data driver IC 310 to the output terminals OUT1 to OUTj.

The output terminals OUT1 to OUTj may be disposed at another side (e.g., lower side) of the base film BSF, which is connected to the display panel 100. Each of the output terminals OUT1 to OUTj may be implemented with, for example, a bump BUMP. In an embodiment, the output terminals OUT1 to OUTj may be integrally formed with the output lines L_OUT1 to L_OUTj, respectively. For example, each of the output terminals OUT1 to OUTj and each of the output lines L_OUT1 to L_OUTj may be integral with each other. The output terminals OUT1 to OUTj may be electrically connected to the data lines DL1 to DLj in the display panel 100, respectively. The output lines L_OUT1 to L_OUTj may be electrically connected to the data lines DL1 to DLj through the output terminals OUT1 to OUTj, respectively. Data signals generated from the data driver IC 310 may be transmitted to the data lines DL1 to DLj in the display panel 100 through the output lines L_OUT1 to L_OUTj and the output terminals OUT1 to OUTj.

For example, a bump BMP electrically connected to each of the output lines L_OUT1 to L_OUTj may be electrically connected to a pad PAD electrically connected to each of the data lines DL1 to DLj through a connection film such as an anisotropic conductive film ACF. For example, the bump BMP may constitute each of the output terminals OUT1 to OUTj, and the pad PAD may be formed on a substrate SUB of the display panel 100. The pad PAD may be disposed in the non-display area 120 (see FIG. 1) of the display panel 100.

The contact resistance described with reference to FIG. 1 may be changed according to a bonding state between the data drive circuit film 320 and the display panel 100. For example, the contact resistance may be changed according to an alignment state between the bump BUMP and the pad PAD and a connection state of conductive particles in the anisotropic conductive film ACF. The conductive particles in the anisotropic conductive film ACF may form an electrical conduction path between the bump BUMP and the pad PAD. Although the bump BUMP and the pad PAD are aligned, the contact resistance may be changed, in case that the conductive particles in the anisotropic conductive film ACF are not normally connected or in case that a defect occurs in the conductive particles. For example, the contact resistance may be increased due to denting trace of the conductive particles, which may be formed, e.g., on the surface of the bump BUMP or the pad PAD by an impact or an excessive pressure during manufacturing processes.

In another embodiment, the denting trace of the conductive particles may be visually checked by using a scope or the like. However, a relatively long time may be taken to check denting trace of the conductive particles with respect to all the data lines DL1 to DLj using the scope or the like, and a contact resistance may be predicted based on the denting trace of the conductive particles. Accordingly, the data driver IC 310 may measure the slew rate with respect to each of the data lines DL1 to DLj and compare the measured slew rate with a reference slew rate, so that a contact resistance of each of the data lines DL1 to DLj may be monitored without the scope or the like.

Figure 4:
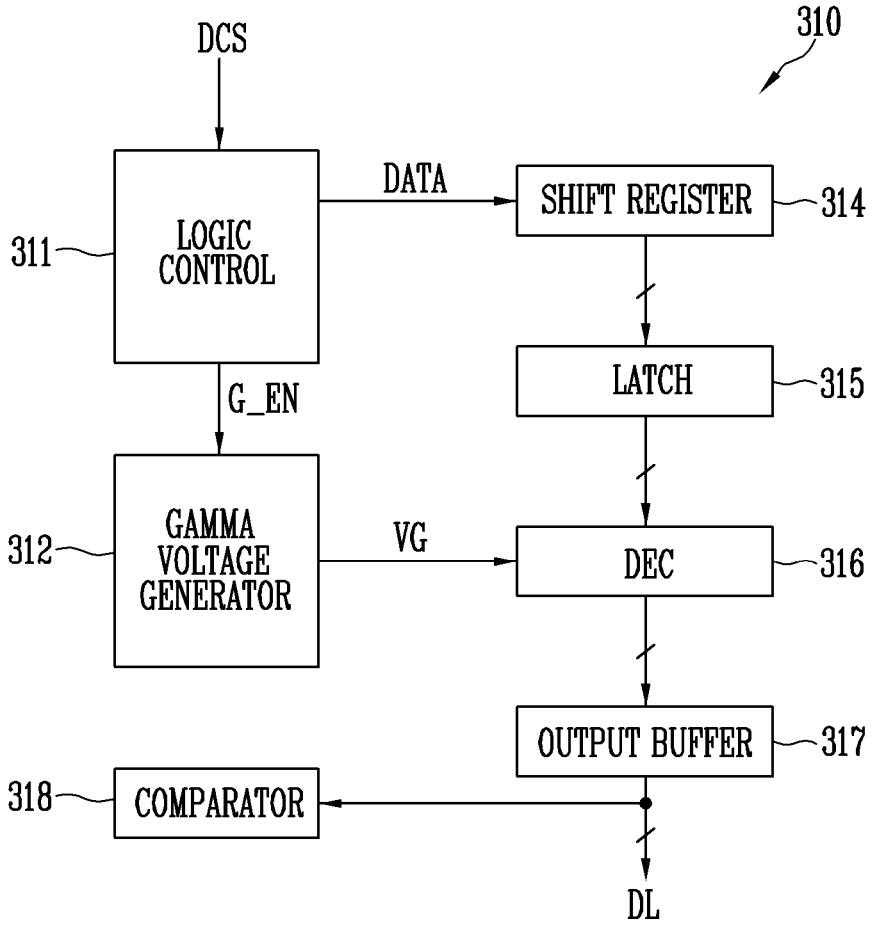
FIG. 4 is a schematic diagram illustrating the data driver IC of the display device shown in FIG. 1.

FIG. 4 is a schematic diagram illustrating the data driver IC of the display device shown in FIG. 1.

Referring to FIGS. 1 and 4, a data driver IC 310 may include a logic control 311 (or control block), a gamma voltage generator 312 (or gamma voltage generation block), a shift register 314, a latch 315, a decoder 316 (e.g., digital-analog converter or digital-analog conversion block), an output buffer 317 (or output buffer block), and a comparator 318 (e.g., comparison block or measurer).

The logic control 311 may receive the data control signal DCS from the timing controller 410. The logic control 311 may change serialized data received from the timing controller 410 (see FIG. 1) to parallelized data DATA. The logic control 311 may provide the parallelized data DATA to the shift register 314 (or the latch 315).

The logic control 311 may generate a gamma enable signal G_EN based on the data control signal DCS. The gamma enable signal G_EN may control the gamma voltage generator 312 to generate gamma voltages VG. The gamma voltages VG may be used to convert the parallelized data DATA into a data signal (e.g., grayscale voltage). The gamma voltages VG may include multiple gamma voltages corresponding 8-bit data, 11-bit data, or the like.

The gamma voltage generator 312 may receive the gamma enable signal G_EN, and generate gamma voltages VG having various voltage levels.

The shift register 314 may provide the parallelized data DATA to the latch 315. The shift register 314 may generate a latch clock signal and provide the generated latch clock signal to the latch 315. The latch clock signal may be used to control a timing at which the parallelized data DATA is output.

The latch 315 may latch or temporarily store data sequentially received from the shift register 314, and transfer the data to the decoder 316.

The decoder 316 may convert data (i.e., a grayscale value of the parallelized data DATA) in a digital form into a data signal (or data voltage) in an analog form by using the gamma voltages VG. For example, the decoder 316 may generate a data signal corresponding to a grayscale value of image data.

The output buffer 317 may receive the data signal and output the received data signal to the outside (e.g., data line DL) of the data driver IC 310. The output buffer 317 may include a source buffer (or output buffer) electrically connected to the data line DL. For example, as described with reference to FIGS. 2 and 3, in case that the data driver IC 310 is electrically connected to the data lines DL1 to DLj, the output buffer 317 may include multiple source buffers corresponding to the data lines DL1 to DLj.

The comparator 318 may be electrically connected to an output terminal of the output buffer 317, and measure or calculate the slew rate of the data signal provided to the data line DL or a slew rate of a channel of the data driver IC 310. The data signal may be output through the channel of the data driver IC 310. Also, the comparator 318 may compare the slew rate of the data signal with the reference slew rate (or reference value).

Further description of the comparator 318 is provided below with reference to FIGS. 5 to 8B.

Figure 5:
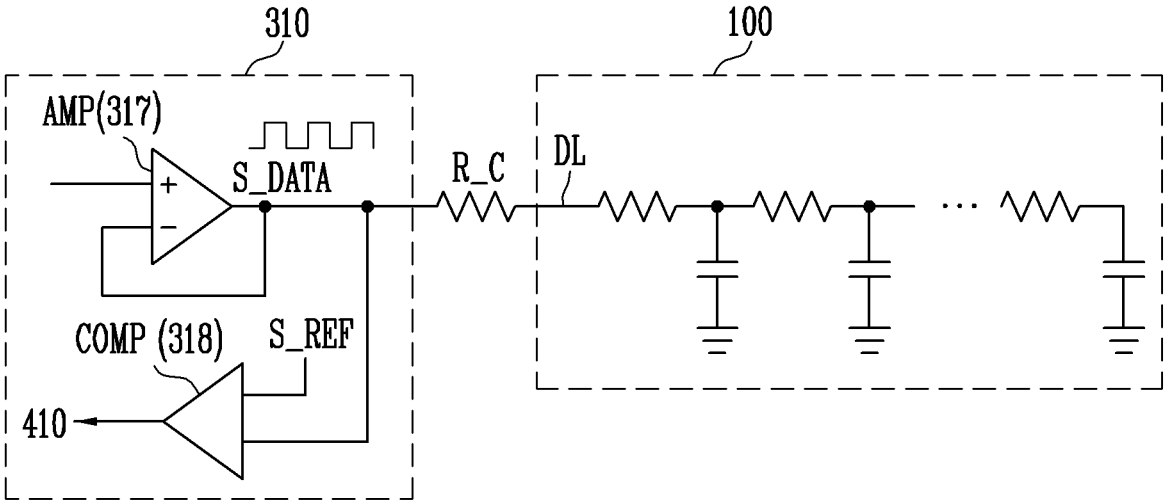
FIG. 5 is a schematic diagram illustrating a connection configuration of a comparator of the data driver IC shown in FIG. 4.
Figure 6:
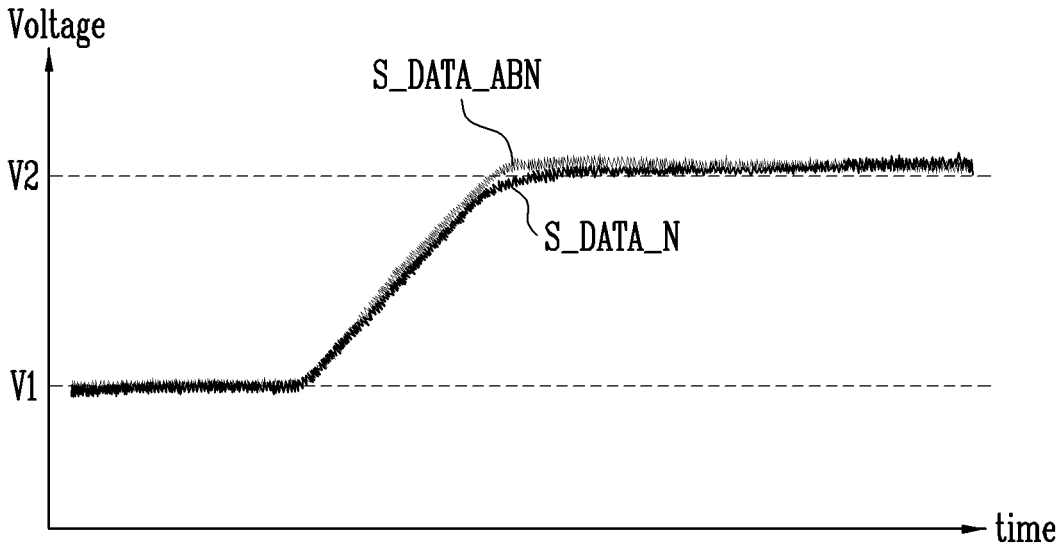
FIG. 6 is a schematic waveform diagram illustrating a data signal measured at a first point shown in FIG. 5.
Figure 7:
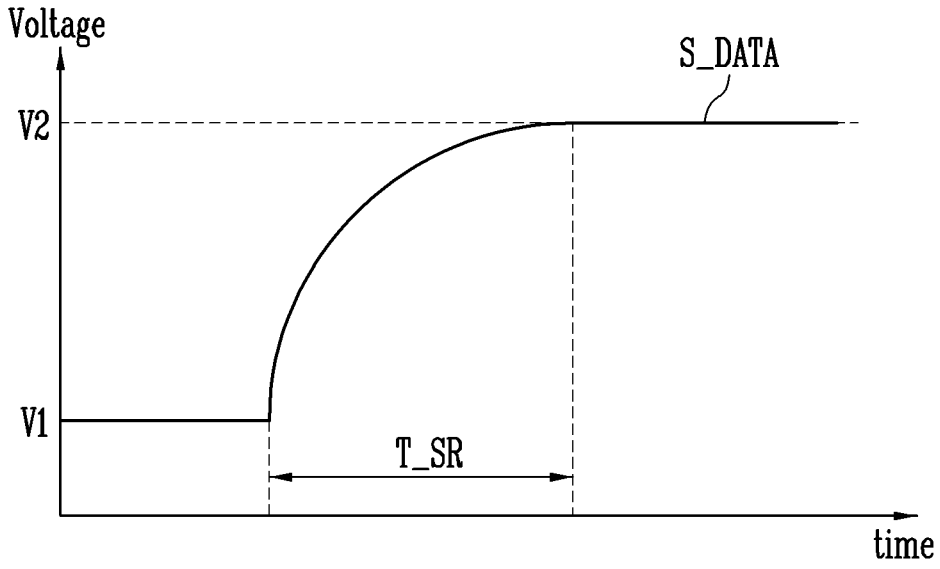
FIG. 7 is a schematic waveform diagram illustrating an operation of the comparator of the data driver IC shown in FIG. 4.
Figure 8A:
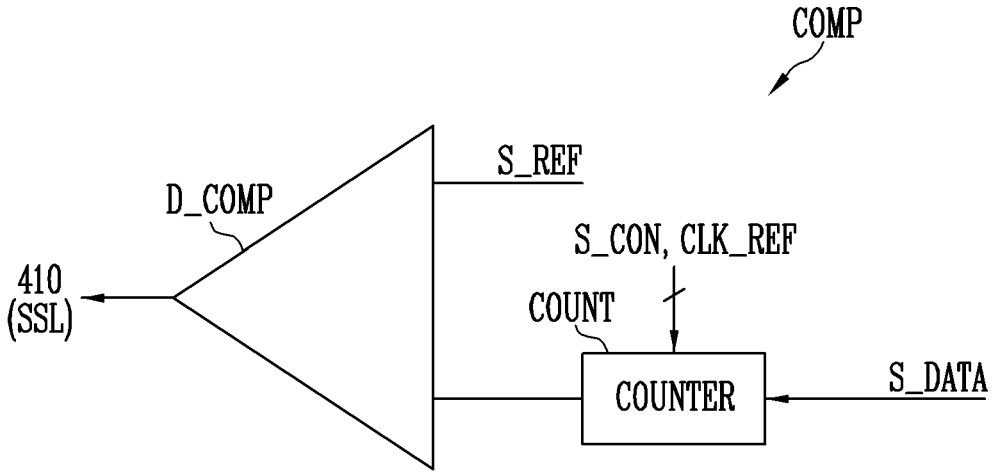
FIGS. 8A and 8B are schematic diagrams illustrating embodiments of the comparator shown in FIG. 5.
Figure 8B:
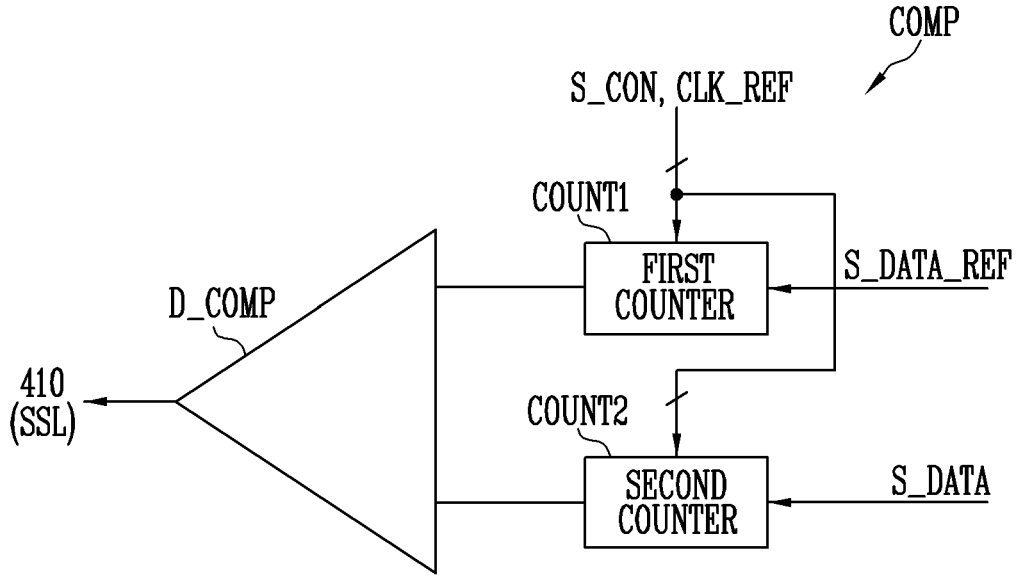

FIG. 5 is a schematic diagram illustrating a connection configuration of the comparator of the data driver IC shown in FIG. 4. In FIG. 5, the comparator 318 is illustrated with respect to one data line DL. FIG. 6 is a schematic waveform diagram illustrating a data signal measured at an output terminal of a source buffer shown in FIG. 5. FIG. 7 is a schematic waveform diagram illustrating an operation of the comparator of the data driver IC shown in FIG. 4. FIGS. 8A and 8B are schematic diagrams illustrating embodiments of the comparator shown in FIG. 5.

Referring to FIGS. 1 to 7, the comparator 318 may include a comparator COMP (or comparison circuit). The comparator COMP may be electrically connected to an output terminal of a source buffer AMP (or output buffer) of the output buffer 317. The source buffer AMP may include an amplifier. As described with reference to FIG. 3, a contact resistor R_C may exist between the output buffer 317 and the data line DL, and the output buffer 317 may be electrically connected to the data line DL through the contact resistor R_C. Resistors and capacitors of FIG. 5, which are electrically connected to the data line DL, may represent resistor and capacitor components caused by the pixels PXL (see FIG. 1) and lines electrically connected to the pixels PXL.

The comparator COMP may receive a data signal S_DATA from the output terminal of the source buffer AMP of the output buffer 317. In the slew rate test mode, the data signal S_DATA may be a square wave that periodically (or repeatedly) alternates between a first level and a second level different from the first level. The data signal S_DATA having the form of the square wave may be referred to as an H-stripe pattern. For example, the first level may have a first voltage level V1 corresponding to one of a first grayscale (e.g., minimum grayscale value corresponding to black color, i.e., grayscale value of 0) and a second grayscale (e.g., maximum grayscale value corresponding to white color, i.e., grayscale value of 255), and the second level may have a second voltage level V2 corresponding to another of the first grayscale and the second grayscale.

As shown in FIG. 6, in a period in which the data signal S_DATA is changed from the first voltage level V1 to the second voltage level V2, a slew rate of the data signal S_DATA may be changed according to a resistance value of the contact resistor R_C.

For example, in case that the resistance value of the contact resistor R_C is within a normal range, a time (e.g., period) for which a normal data signal S_DATA_N is changed from the first voltage level V1 to the second voltage level V2 (i.e., a transition time T_SR (see FIG. 7)) may be about 346 ns. For example, in case that the resistance value of the contact resistor R_C is out of the normal range (e.g., in case that the contact resistor R_C has a relatively large resistance value or the contact resistor R_C is defective), a time (e.g., period) for which an abnormal data signal S_DATA_ABN is changed from the first voltage level V1 to the second voltage level V2 may be about 384 ns. For example, a slew rate of the abnormal data signal S_DATA_ABN may be different from that of the normal data signal S_DATA_N.

In an embodiment, the comparator COMP may measure or calculate the slew rate of the data signal S_DATA. For example, as shown in FIG. 7, a transition time T_SR (e.g., transition period) may be a time (e.g., period) from a time (e.g., time point) at which the data signal S_DATA starts being changed toward the second voltage level V2 from the first voltage level V1 to a time (e.g., time point) at which the data signal S_DATA reaches the second voltage V2. For example, the transition time T_SR may be calculated or determined as the slew rate of the data signal S_DATA.

Also, the comparator COMP may receive a reference slew rate S_REF, and compare the slew rate of the data signal S_DATA with the reference slew rate S_REF. The reference slew rate S_REF may be predetermined, and may be stored in a memory device (not illustrated) in the data driver IC 310 or be provided from the outside. A comparison result of the comparator COMP may be provided to the timing controller 410 through the sharing signal line SSL as described with reference to FIG. 2.

In an embodiment, as shown in FIG. 8A, the comparator COMP may include a counter COUNT and a digital comparator D_COMP.

The counter COUNT may receive a reference clock signal CLK_REF and the data signal S_DATA, and calculate the transition time T_SR of the data signal S_DATA based on the reference clock signal CLK_REF. For example, the counter COUNT may calculate the transition time T_SR by counting a number of pulses of the reference clock signal CLK_REF while the data signal S_DATA is changed from the first voltage level V1 to the second voltage level V2.

The reference clock signal CLK_REF may be provided from the outside. For example, the reference clock signal CLK_REF may be a clock signal used for the data clock signal line DCSL (see FIG. 2) between the timing controller 410 and the data driver IC 310. For example, in case that a data transmission speed of the data clock signal line DCSL is 2.6 Gbps, a cycle of the reference clock signal CLK_REF may be about 384 ps (i.e., 1 s/2.6 G). For example, a time (e.g., period) for which one pulse of the reference clock signal CLK_REF is counted may be defined as 1 UI (unit time). As described with reference to FIG. 6, in case that the transition time T_SR of the abnormal data signal S_DATA_ABN is about 384 ns, the transition time T_SR of the abnormal data signal S_DATA_ABN may be expressed as about 1000 UI. Similarly, in case that the transition time T_SR of the normal data signal S_DATA_N is about 346 ns, the transition time T_SR of the normal data signal S_DA- TA_N may be expressed as about 900 UI. For example, in case that the clock signal used for the data clock signal line DSCL (see FIG. 2) is used as the reference clock signal CLK_REF, comparison having even a slew rate difference (e.g., transition time difference or slew rate resolution) of 1 ns or less may be possible.

In an embodiment, the counter COUNT may further receive a counter control signal S_CON, and calculate the transition time T_SR by counting the number of the pulses of the reference clock signal CLK_REF until the data signal S_DATA reaches the second voltage level V2 in response to the counter control signal S_CON. The counter control signal S_CON may control a counting operation of the counter COUNT, and may be provided from the outside. For example, the counter control signal S_CON may be provided from the logic control 311.

The digital comparator D_COMP may compare an output of the counter COUNT (i.e., the slew rate of the data signal S_DATA or the transition time T_SR) with the reference slew rate S_REF (i.e., reference transition time). For example, the reference slew rate (or reference value) may be about 900 UI based on the transition time T_SR of the normal data signal S_DATA.

For example, in case that the slew rate of the data signal S_DATA is equal or similar to the reference slew rate S_REF or belongs to an error allow range with respect to the reference slew rate S_REF, the digital comparator D_COMP may output a comparison result having a first value (e.g., value of 1 or logic high level) to the sharing signal line SSL. For example, the digital comparator D_COMP may output the comparison result having the first value in case that the slew rate of the data signal S_DATA is within the error allow range. For example, in case that the slew rate of the data signal S_DATA is different from the reference slew rate S_REF or is out of the error allow range with respect to the reference slew rate S_REF, the digital comparator D_COMP may output a comparison result having a second value (e.g., value of 0 or logic low level) to the sharing signal line SSL. For example, the digital comparator D_COMP may output the comparison result having the second value in case that the slew rate of the data signal S_DATA is out of the error allow range.

Although the comparator COMP of FIG. 8A receives the reference slew rate S_REF. However, the disclosure is not limited thereto. The comparator COMP may receive a reference data signal S_DATA_REF instead of the reference slew rate S_REF based on the reference data signal S_DATA_REF.

In another embodiment, as shown in FIG. 8B, the comparator COMP may include a first counter COUNT1, a second counter COUNT2, and a digital comparator D_COMP. Each of the first counter COUNT1 and the second counter COUNT2 is substantially identical or similar to the counter COUNT shown in FIG. 8A, and therefore, detailed descriptions of the same constituent elements is omitted.

Referring to FIG. 8B, the first counter COUNT1 may receive a reference data signal S_DATA_REF, and calculate a reference transition time (i.e., reference slew rate by counting a number of pulses of the reference clock signal CLK_REF while the reference data signal S_DATA_REF is changed from the first voltage level V1 to the second voltage level V2. Similar to the source buffer AMP shown in FIG. 5, the reference data signal S_DATA_REF may be provided from a dummy source buffer (not illustrated) electrically connected to an ideal contact resistor (not illustrated).

The second counter COUNT2 may calculate a reference transition time (i.e., a reference slew rate by counting a number of pulses of the reference clock signal CLK_REF while the data signal S_DATA is changed from the first voltage level V1 to the second voltage level V2. Similar to the source buffer AMP shown in FIG. 5, the data signal S_DATA may be provided from the dummy source buffer (not illustrated) electrically connected to the ideal contact resistor (not illustrated).

The digital comparator D_COMP may compare an output of the first counter COUNT1 (i.e., a slew rate of the reference data signal S_DATA_REF) with an output of the second counter COUNT2 (i.e., a slew rate of the data signal S_DATA).

As described above, the data driver IC 310 may calculate a slew rate (or transition time T_SR) of the data signal S_DATA by using the reference clock signal CLK_REF, compare the slew rate (or transition time T_SR of the data signal S_DATA) with the reference slew rate S_REF (or reference transition time), and provide a comparison result to the timing controller 410 through the sharing signal line SSL. Thus, the timing controller 410 may determine whether the contact resistor R_C is within a normal range based on the comparison result.

Figure 9A:
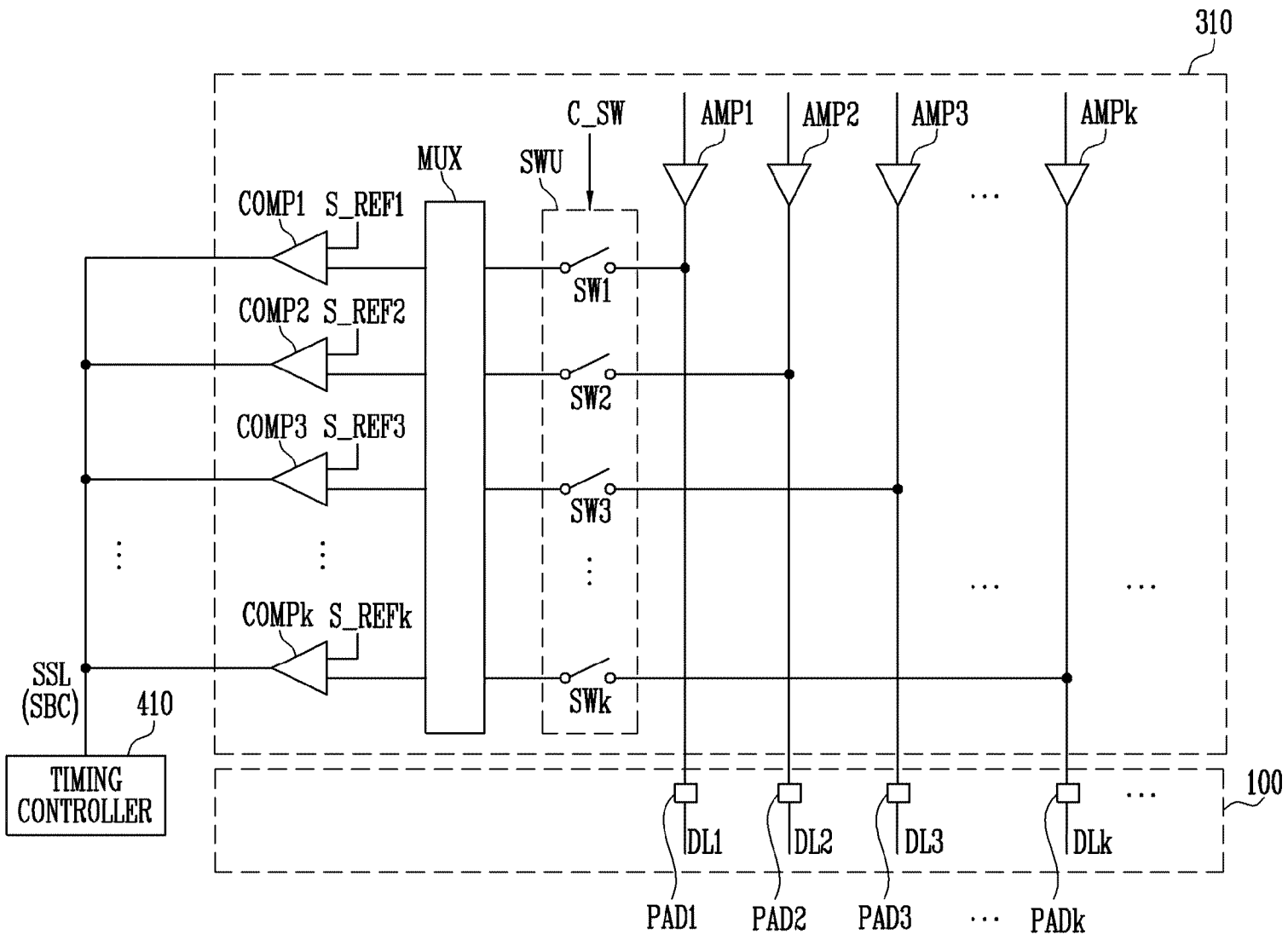
FIGS. 9A, 9B, and 9C are schematic diagrams illustrating embodiments of the data driver IC of the display device shown in FIG. 1.
Figure 9B:
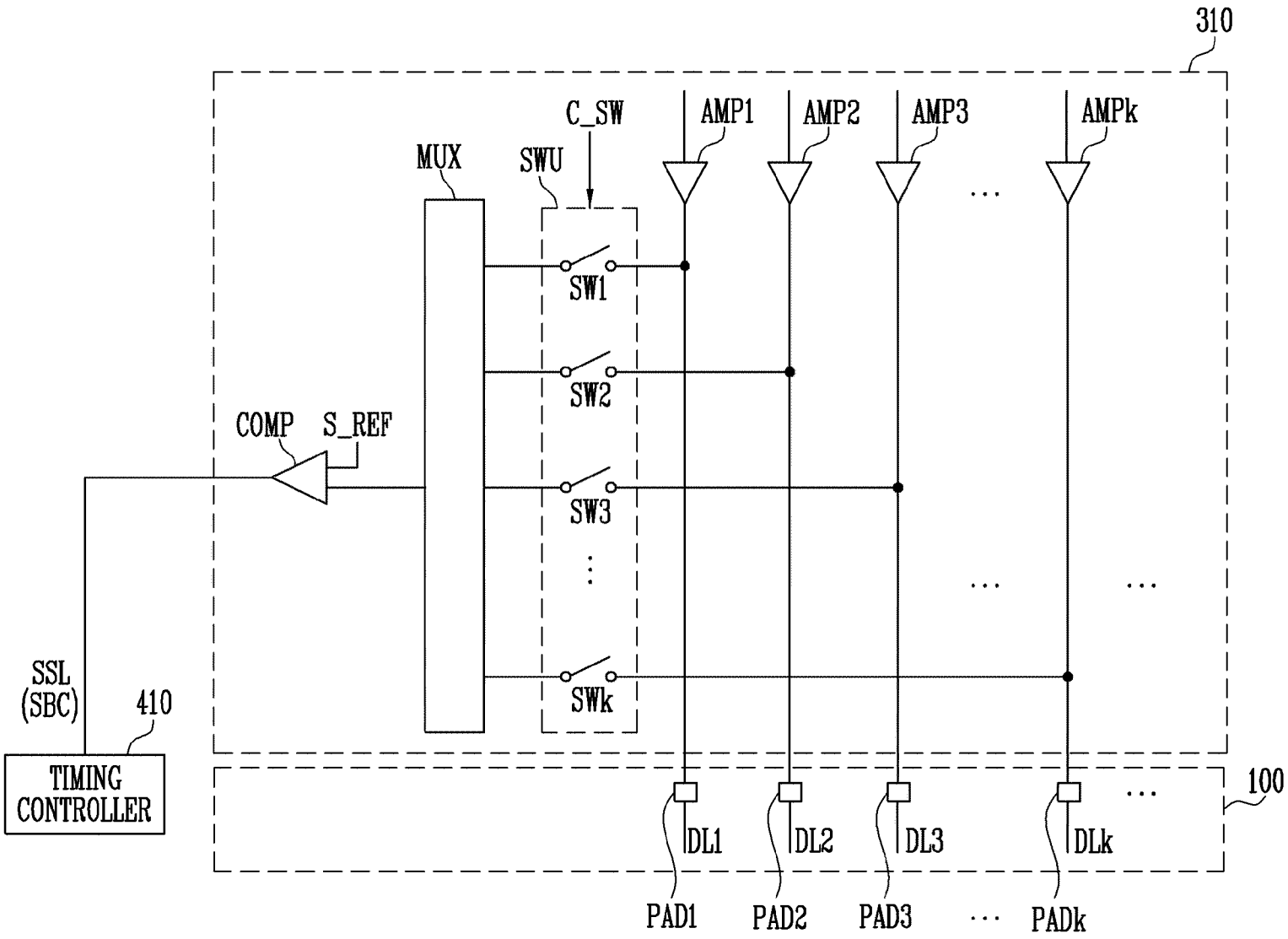
Figure 9C:
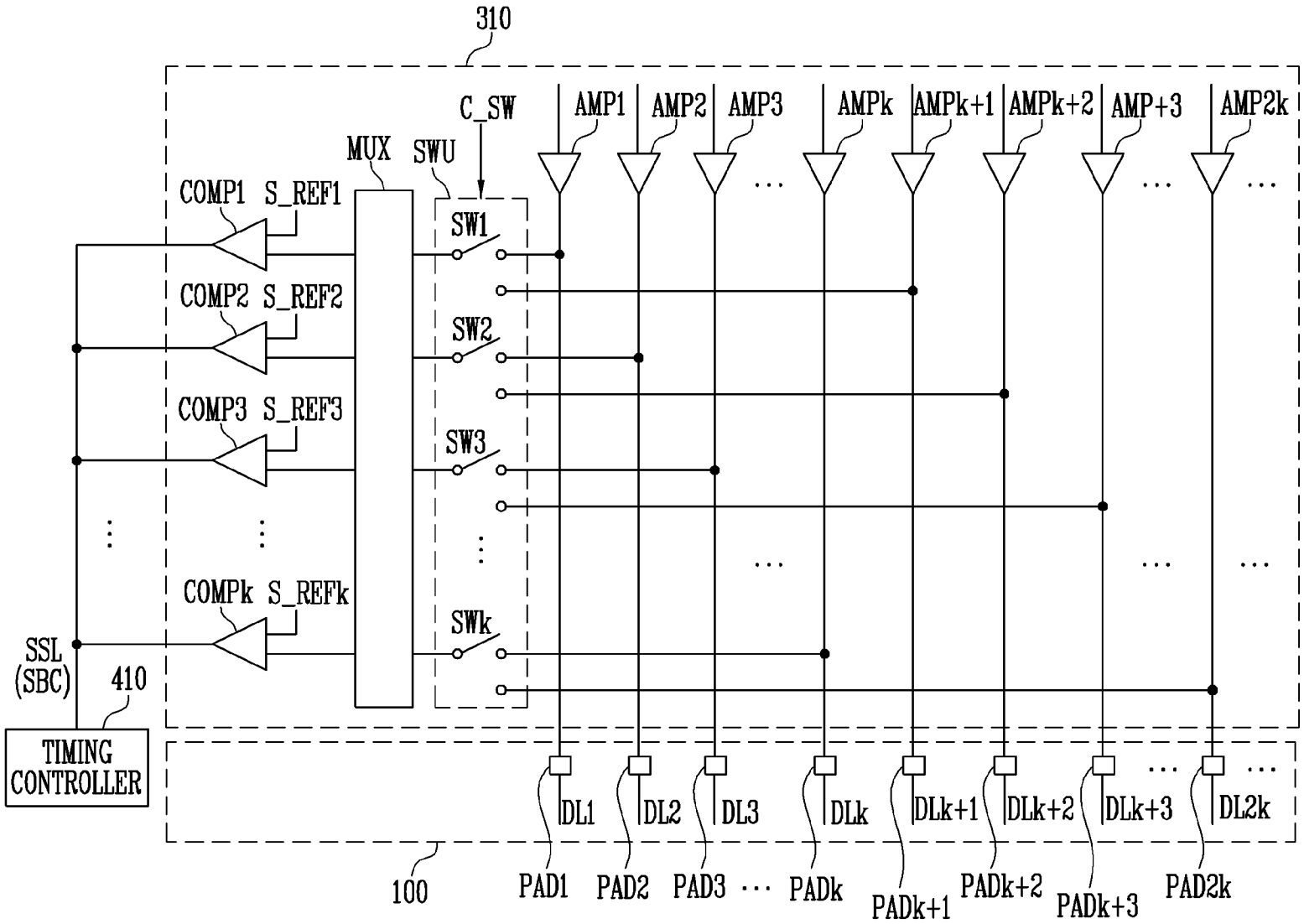

FIGS. 9A, 9B, and 9C are schematic diagrams illustrating embodiments of the data driver IC of the display device shown in FIG. 1. In FIGS. 9A to 9C, a portion of the display panel 100 and the timing controller 410, which are electrically connected to the data driver IC 310, are illustrated.

Referring to FIGS. 1 to 9A, a data driver IC 310 may include source buffers AMP1 to AMPk (or output buffers), a switch part SWU, a multiplexer MUX, and comparators COMP1 to COMPk. Here, k is a positive integer.

Each of the source buffers AMP1 to AMPk may be substantially identical or similar to the source buffer AMP described with reference to FIG. 5. The source buffers AMP1 to AMPk may be electrically connected to data lines DL1 to DLk through pads PAD1 to PADk, respectively. The pads PAD1 to PADk and the data lines DL1 to DLk may be included in the display panel 100. For example, a first source buffer AMP1 may be electrically connected to a first data line DL1 through a first pad PAD1. A second source buffer AMP2 may be electrically connected to a second data line DL2 through a second pad PAD2. The second pad PAD2 may be located closer to the inside of the display panel 100 than the first pad PAD1, and the first pad PAD1 may be located at the outermost portion among the pads PAD1 to PADk. A third source buffer AMP3 may be electrically connected to a third data line DL3 through a third pad PAD3. A kth source buffer MAPk may be electrically connected to a kth data line DLk through a kth pad PADk.

The switch part SWU may be disposed between the multiplexer MUX and the source buffers AMP1 to AMPk, and electrically connect the source buffers AMP1 to AMPk to the multiplexer MUX. For example, the switch part SWU may electrically connect output terminals of the source buffers AMP1 to AMPk to the multiplexer MUX in response to a switch control signal C_SW. For example, the switch part SWU may electrically connect the output terminals of the source buffers AMP1 to AMPk to the multiplexer MUX in the slew rate test mode.

The switch part SWU may include switches SW1 to SWk. For example, a first switch SW1 may be electrically connected between an output terminal of the first source buffer AMP1 and an input terminal of the multiplexer MUX. A second switch SW2 may be electrically connected between an output terminal of the second source buffer AMP2 and an input terminal of the multiplexer MUX. A third switch SW3 may be electrically connected between an output terminal of the third source buffer AMP3 and an input terminal of the multiplexer MUX. A kth switch SWk may be electrically connected between an output terminal of the kth source buffer AMPk and an input terminal of the multiplexer MUX. In another embodiment, the switch part SWU may be omitted.

The multiplexer MUX may be disposed between the comparators COMP1 to COMPk and the switch part SWU (or source buffers AMP1 to AMPk), and selectively transfer outputs of the source buffers AMP1 to AMPk to the comparators COMP1 to COMPk.

For example, the multiplexer MUX may transfer an output of the first source buffer AMP1 to a first comparator COMP1 in a first period. The multiplexer MUX may transfer an output of the second source buffer AMP2 to a second comparator COMP2 in a second period. The multiplexer MUX may transfer an output of the third source buffer AMP3 to a third comparator COMP3 in a third period. The multiplexer MUX may transfer an output of the kth source buffer AMPk to a kth comparator COMPk in a kth period.

Each of the comparators COMP1 to COMPk may be substantially identical or similar to the comparator COMP described with reference to FIGS. 5, 8A, and 8B.

The comparators COMP1 to COMPk may respectively receive reference slew rates S_REF1 to S_REFk (or reference values). For example, the first comparator COMP1 may receive a first reference slew rate S_REF1 (or first reference value). The second comparator COMP2 may receive a second reference slew rate S_REF2 (or second reference value). The third comparator COMP3 may receive a third reference slew rate S_REF3 (or third reference value). The kth comparator COMPk may receive a kth reference slew rate S_REFk (or kth reference value). At least some of the reference slew rates S_REF1 to S_REFk may be different from each other.

Pixels may include light emitting elements emitting lights of different colors. The pixels may be electrically connected to the data lines DL1 to DLk. For example, a first pixel electrically connected to the first data line DL1 may include a first light emitting element emitting light of a first color (e.g., red). A second pixel electrically connected to the second data line DL2 may include a second light emitting element emitting light of a second color (e.g., green). A third pixel electrically connected to the first data line DL1 (and the kth data line DLk) may include a third light emitting element emitting light of a third color (e.g., blue). A voltage level (e.g., first voltage level V1 or second voltage level V2) of a data signal corresponding to a same grayscale value (e.g., maximum grayscale value corresponding to white color) may be changed for (or different from) each pixel, and a transition time (e.g., transition period) T_SR of the data signal may also be changed for (or different from) each pixel. Therefore, comparators COMP1 to COMPk may be provided in the data driver IC 310, and at least some of the comparators COMP1 to COMPk may respectively receive different reference slew rates S_REF1 to S_REFk.

Each of the comparators COMP1 to COMPk may measure or calculate a slew rate of a data signal provided through the multiplexer MUX, compare the slew rate with a corresponding reference slew rate, and provide a comparison result (or feedback signal) to the timing controller 410 through the sharing signal line SSL.

For example, in the first period, the first comparator COMP1 may calculate a first slew rate of a first data signal, compare the first slew rate with the first reference slew rate S_REF1, and provide a first comparison result to the timing controller 410 through the sharing signal line SSL. The first data signal may be provided to the first data line DL1 from the first source buffer AMP1, and the first comparison result may correspond to a contact resistance between the first source buffer AMP1 and the first data line DL1. For example, in the second period, the second comparator COMP2 may calculate a second slew rate of a second data signal, compare the second slew rate with the second reference slew rate S_REF2, and provide a second comparison result to the timing controller 410 through the sharing signal line SSL. The second data signal may be provided to the second data line DL2 from the second source buffer AMP2, and the second comparison result may correspond to a contact resistance between the second source buffer AMP2 and the second data line DL2. For example, in the third period, the third comparator COMP3 may calculate a third slew rate of a third data signal, compare the third slew rate with the third reference slew rate S_REF3, and provide a third comparison result to the timing controller 410 through the sharing signal line SSL. The third data signal may be provided to the third data line DL3 from the third source buffer AMP3, and the third comparison result may correspond to a contact resistance between the third source buffer AMP3 and the third data line DL3. For example, in the kth period, the kth comparator COMPk may calculate a kth slew rate of a kth data signal, compare the kth slew rate with the kth reference slew rate S_REFk, and provide a kth comparison result to the timing controller 410 through the sharing signal line SSL. The kth data signal may be provided to the kth data line DLk from the kth source buffer AMPk, and the kth comparison result may correspond to a contact resistance between the kth source buffer AMPk and the kth data line DLk.

Although the data driver IC 310 of FIG. 9A includes the comparators COMP1 to COMPk, the disclosure is not limited thereto.

For example, in case that the pixels (e.g., pixels electrically connected to the data lines DL1 to DLk) include light emitting elements emitting light of a same color, the data driver IC 310 may include one comparator COMP as shown in FIG. 9B. The comparator COMP shown in FIG. 9B may sequentially compare data signals sequentially provided from the multiplexer MUX with a reference slew rate S_REF (or reference value), and sequentially provide comparison results to the timing controller 410 through the sharing signal line SSL.

In another embodiment, source buffers AMP1 to AMPk and AMPk+1 to AMP2*k* may be grouped into groups (or channel groups), and the switch part SMU may selectively connect the groups to the multiplexer MUX.

Referring to FIG. 9C, (k+1)th to 2kth source buffers AMPk+1 to AMP2*k* of the data driver IC 310 are further illustrated. The (k+1)th to 2kth source buffers AMPk+1 to AMP2*k* may be electrically connected to (k+1)th to 2kth data lines DLk+1 to DL2*k* through (k+1)th to 2kth pads PADk+1 to PAD2*k*, respectively.

The first to kth source buffers AMP1 to AMPk may be grouped as a first group, and the (k+1)th to 2kth source buffers AMPk+1 to AMP2*k* may be grouped as a second group. For example, one group may include k source buffers, so that the source buffers of the data driver IC 310 may be grouped into multiple groups (or channel groups).

For example, the switch part SWU may electrically connect the first group (i.e., the first to kth source buffers AMP1 to AMPk) to the multiplexer MUX in a first group period, and electrically connect the second group (i.e., the (k+1)th to 2kth source buffers AMPk+1 to AMP2*k*) to the multiplexer MUX in a second group period.

For example, the first switch SW1 may electrically connect an output terminal of the first source buffer AMP1 and an output terminal of the multiplexer MUX to each other in the first group period, and electrically connect an output terminal of the (k+1)th source buffer AMPk+1 and an input terminal of the multiplexer MUX to each other in the second group period. Similarly, the second switch SW2 may electrically connect an output terminal of the second source buffer AMP2 and an input terminal of the multiplexer MUX to each other in the first group period, and electrically connect an output terminal of the (k+1)th source buffer AMPk+1 and an input terminal of the multiplexer MUX to each other in the second group period. The kth switch SWk may electrically connect an output terminal of the kth source buffer AMPk and an input terminal of the multiplexer MUX to each other in the first group period, and electrically connect an output terminal of the 2kth source buffer AMP2*k* and an input terminal of the multiplexer MUX to each other in the second group period.

For example, in case that the data driver IC 310 includes 960 source buffers, each group may include 12 source buffers, and the 960 source buffers may be grouped into 80 groups. The switch part SWU may sequentially connect the 80 groups (or channel groups) to the multiplexer MUX in different 80 group periods.

The groups (i.e., groups each including k source buffers) may be electrically connected to the multiplexer MUX by using the switch part SWU, and a data signal may be selectively provided to the comparators COMP1 to COMPk (or comparator COMP) by using the multiplexer MUX, so that the number of the comparators COMP1 to COMPk (or comparator COMP) may be decreased.

As described above, the source buffers AMP1 to AMP2*k* in the data driver IC 310 are grouped into the groups (or channel groups), and the switch part SWU may selectively or sequentially connect the groups to the multiplexer MUX. The multiplexer MUX may sequentially provide the data signals provided from the connected group to at least one of the comparators COMP or COMP1 to COMPk, and the at least one of the comparators COMP or COMP1 to COMPk may compare the data signals with at least one of the reference slew rates S_REF or S_REF1 to S_REFk. The comparators COMP or COMP1 to COMPk may sequentially provide the comparison results to the timing controller 410 through the sharing signal line SSL. Thus, a contact resistance with respect to each of the data lines DL1 to DL2*k* may be monitored.

Figure 10:
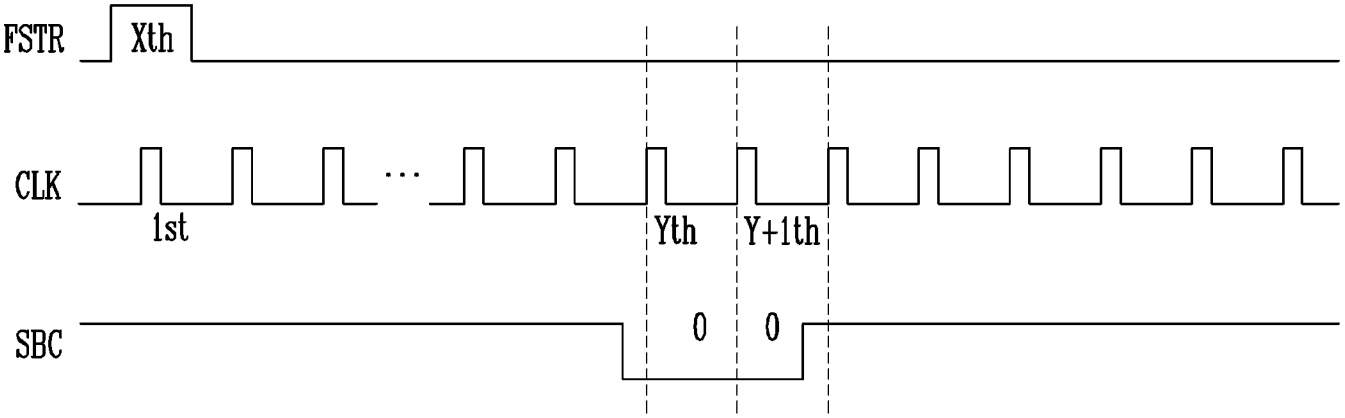
FIG. 10 is a schematic waveform diagram illustrating a comparison result provided to the timing controller from the data driver IC shown in FIG. 9A.

FIG. 10 is a schematic waveform diagram illustrating a comparison result provided to the timing controller from the data driver IC shown in FIG. 9A.

Referring to FIGS. 9A to 9C and 10, a frame start signal FSTR is a signal representing a start of a frame (or frame period). A pulse of the frame start signal FSTR, which has a logic high level, may correspond to a start time (e.g., start time point) of the corresponding frame. The frame start signal FSTR may correspond to a vertical synchronization (VSync) signal.

For example, in the slew rate test mode, an Xth pulse Xth of the frame start signal FSTR may represent a start of an Xth frame, and an Xth data driver IC among the data driver ICs 310 shown in FIG. 1 may output a comparison result (i.e., a result obtained by comparing a slew rate of a data signal with a reference slew rate) in the Xth frame. The comparison result may be included in the second control signal SBC (or feedback signal) described with reference to FIG. 2, and be provided to the timing controller 410 (see FIG. 9A) through the sharing signal line SSL (see FIG. 9A).

For example, each of the data driver ICs 310 may sequentially output a comparison result in a corresponding frame.

A clock signal CLK may define timings (e.g., time points) at which comparison results corresponding to the data lines DL1 to DLk are respectively output, and pulses of the clock signal CLK may respectively correspond to the timings (e.g., time points) at which the comparison results are respectively output. The clock signal CLK may correspond to a horizontal synchronization (HSync) signal.

For example, a first pulse of the clock signal CLK may correspond to a timing (e.g., time point) at which a comparison result corresponding to the first data line DL1 is output. For example, the comparison result of the first pulse may correspond to a first contact resistor between the first source buffer AMP1 and the first data line DL1. A Yth pulse of the clock signal may correspond to a timing (e.g., time point) at which a comparison result corresponding to a Yth data line (or Yth contact resistor) is output, and a (Y+1)th pulse of the clock signal may correspond to a timing (e.g., time point) at which a comparison result corresponding to a (Y+1)th data line (or (Y+1)th contact resistor) is output.

The second control signal SBC (or feedback signal) may include a comparison result described with reference to FIG. 9A. In case that the second control signal SBC has a logic high level (or first value), the corresponding comparison result may represent that the contact resistor is normal. In case that the second control signal SBC has a logic low level (or second value), the corresponding comparison result may represent that the resistance value of the contact resistor is abnormal. However, the second control signal SBC is not limited thereto. For example, the logic high level may represent an abnormal state, and the logic low level may represent a normal state.

As shown in FIG. 10, in case that the second control signal SBC has the logic low level, corresponding to the Yth pulse and the (Y+1)th pulse of the clock signal CLK, it may represent that resistance values of the Yth contact resistor corresponding to the Yth data line (or Yth source buffer) and the (Y+1)th contact resistor corresponding to the (Y+1)th contact resistor corresponding to the (Y+1)th data line (or (Y+1)th source buffer) are abnormal. For example, resistance values of contact resistors corresponding to all the data lines of the display panel 100 (see FIG. 9A) may be monitored based on a state of the second control signal SBC, and positions of portions at which resistance values of contact resistors are defective may be checked based on a time (or period) at which the second control signal SBC has the logic low level (or second value).

Figure 11:
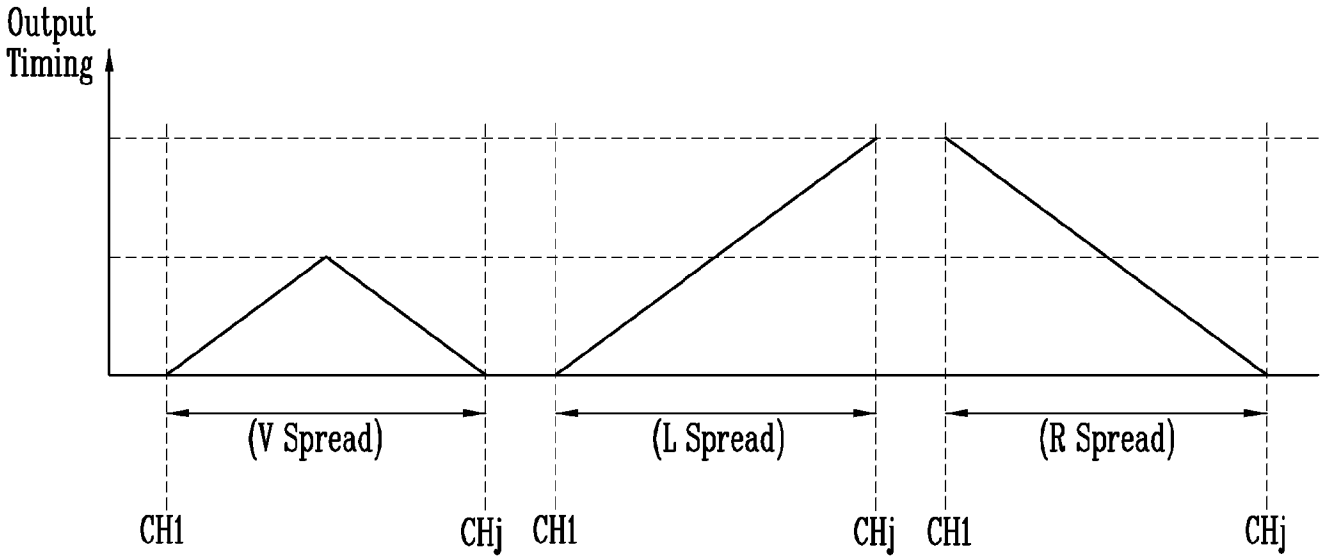
FIGS. 11 and 12 are schematic diagrams illustrating a timing at which a data signal is output from the data driver IC shown in FIG. 9C.
Figure 12:
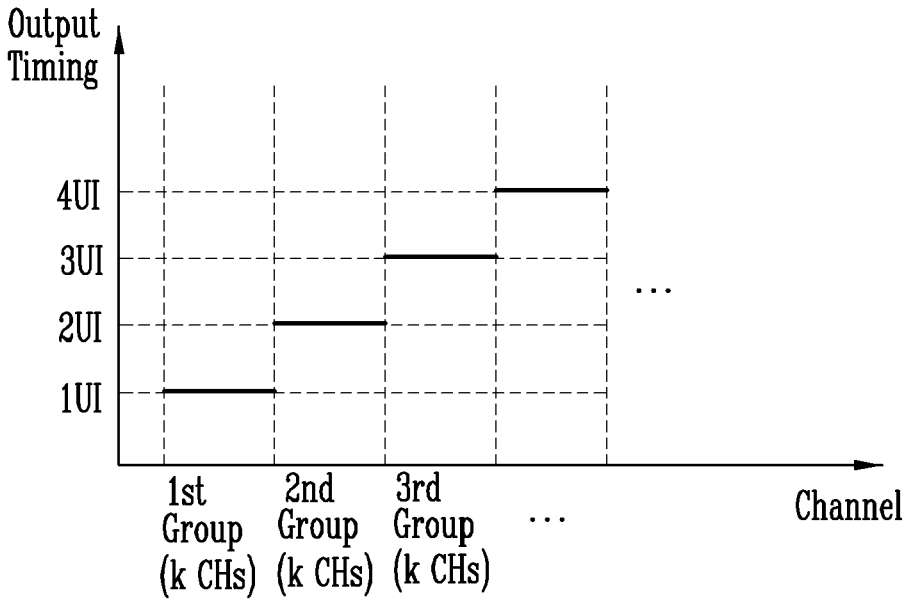

FIGS. 11 and 12 are schematic diagrams illustrating a timing at which a data signal is output from the data driver IC shown in FIG. 9C.

Referring to FIGS. 2, 9A to 9C, 11, and 12, since lengths of the output lines L_OUT1 to L_OUTj of the data drive circuit film 320 (see FIG. 3) are different from each other, a deviation between resistance-capacitance delays (i.e., RC delays) may occur in the output lines L_OUT1 to L_OUTj.

In order to compensation for the deviation between resistance-capacitance delays, the data driver IC 310 may group the channels CH1 to CHj (e.g., the output lines L_OUT1 to L_OUTj or the data lines DL1 to DLj) into channel groups, and set an output timing of a data signal to be changed for each of the channel groups. For example, one channel group may include k channels (k CHs) (e.g., k output lines or k data lines).

The lengths of the output lines L_OUT1 to L_OUTj may be differently set according to a position at which the data driver IC 310 is disposed in the data drive circuit film 320.

For example, as shown in FIG. 3, in case that the data driver IC 310 is mounted in a central area of the data drive circuit film 320, a length of a first output line L_OUT1 and a length of a jth output line L_OUTj may be the longest. The data driver IC 310 may output a data signal to the channels CH1 to CHj by using a V spread method. For example, the data driver IC 310 may output the data signal to the first output line L_OUT1 and the jth output line L_OUTj, which are the longest, among the output lines L_OUT1 to L_OUTj, and delay and output the data signal as becoming more distant from the first output line L_OUT1 and the jth output line L_OUTj. For example, the delayed amount of the data signal may be increased, as the distance from the first output line L_OUT1 and the jth output line L_OUTj is increased.

As shown in FIG. 12, the data signal may be output to a first channel group 1st Group including a first channel CH1 without any delay, may be output to a second channel group 2nd Group by being delayed by 1 UI (unit time), and may be output to a third channel group 3rd Group by being delayed by 2 UI (unit time). The data signal may be output to each of subsequent channel groups by being delayed by 1 UI (unit time) as compared with a previous channel group. The UI (unit time) may be a time (e.g., period) for which one pulse of the reference clock signal CLK_REF is counted as described with reference to FIG. 6. For example, the data driver IC 310 may sequentially latch or store the reference clock signal CLK_REF in a channel group part by using latches, and delay an output timing of a source buffer of a channel group by using the latched reference clock signal.

For example, first timings at which the first to kth source buffers AMP1 to AMPk as shown in FIG. 9C output the data signal may be the same, and the first timing may not include any delay. A second timing at which the (k+1)th to 2kth source buffers AMPk+1 to AMP2*k* shown in FIG. 9C output the data signal may be delayed by 1 UI (unit time) as compared with the first timing.

An input number of the multiplexer MUX described with reference to FIG. 9A (e.g., a number of the switches SW1 to SWk in the switch unit SWU, and/or a number of the comparators COMP1 to COMPk) may be determined by considering that output timings with respect to channels included in one channel group are the same. For example, the input number of the multiplexer MUX (e.g., the number of the switches SW1 to SWk in the switch unit SWU, and/or the number of the comparators COMP1 to COMPk) may be equal to that of channels CHs included in one channel group.

In another example, in case that the data driver IC 310 is mounted in a right area of the data drive circuit film 320 (see FIG. 3), the length of the first output line L_OUT1 may be the longest, and the length of the jth output line L_OUTj may be the shortest. The data driver IC 310 may output a data signal to the channels CH1 to CHj by using an L spread method. For example, the data driver IC 310 may output the data signal to the first output line L_OUT1 having the longest length (i.e., the first channel CH1) among the output lines L_OUT1 to L_OUTj, and lastly output the data signal to the jth output line L_OUTj having the shortest length (i.e., the jth channel CHj) among the output lines L_OUT1 to L_OUTj. As shown in FIG. 12, the data signal may be delay and output for each channel group.

In still another example, in case that the data driver IC 310 is mounted in a left area of the data drive circuit film 320 (see FIG. 3), the length of the first output line L_OUT1 may be the shortest, and the length of the jth output line L_OUTj may be the longest. The data driver IC 310 may output a data signal to the channels CH1 to CHj by using an R spread method. For example, the data driver IC 310 may output the data signal to the jth output line L_OUTj (i.e., the jth channel CHj) and lastly output the data signal to the first output line L_OUT1 (i.e., the first channel CH1). As shown in FIG. 12, the data signal may be delay and output for each channel group.

As described above, in case that the data driver IC 310 outputs a data signal to at least some of the channels CH1 to CHj (or data lines DL1 to DLj) at different times and in case that the data signal is simultaneously output to channels CHs of one channel group, the input number of the multiplexer MUX described with reference to FIG. 9A (e.g., the number of the switches SW1 to SWk in the switch unit SWU, and/or the number of the comparators COMP1 to COMPk) may be equal to that of the channels CHs of the one channel group.

In FIGS. 11 and 12, an output timing of the data signal has been described by using the output lines L_OUT1 to L_OUTj in the data drive circuit film 320 shown in FIG. 3, but the disclosure is not limited thereto. For example, the data lines DL1 to DLj in the display panel 100 may have different lengths, and the output timing of the data signal may be determined based on the data lines DL1 to DLj.

In the data driver and the display device including the same accordance to the disclosure, a slew rate of a data signal applied to each of the data lines may be measured, and the measured slew rate may be compared with a reference slew rate. Thus, a contact resistance with respect to each of the data lines may be monitored. Accordingly, a portion at which a contact resistance is abnormal may be detected, and deterioration of the image display quality on the display panel may be prevented through repair of the corresponding portion or the compensation for the corresponding data signal.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the disclosure.

What is claimed is:

1. A display device comprising:

a display panel including:

data lines; and pixels electrically connected to the data lines; and a data driver that supplies data signals to the data lines, wherein the data driver includes:

a first output buffer electrically connected to a first data line of the data lines, the first output buffer outputting a first data signal to the first data line; and a first comparator electrically connected to an output terminal of the first output buffer, the first comparator comparing a first slew rate of the first data signal with a first reference slew rate;

wherein the first reference slew rate is based on a contact resistance between the data driver and one or more of the data lines.

2. The display device of claim 1, wherein the first slew rate of the first data signal is changed according to a resistance of a contact resistor disposed between the first output buffer and the first data line.

3. The display device of claim 2, further comprising:

a controller that determines whether the resistance is within a normal range based on a comparison result of the first comparator.

4. The display device of claim 1, wherein the first data signal is a square wave having a first voltage level or a second voltage level, and the first comparator determines a transition time from the first voltage level to the second voltage level as the first slew rate of the first data signal.

5. The display device of claim 4, wherein the first comparator includes:

a first counter that calculates the transition time based on a reference clock signal; and a digital comparator that compares an output of the first counter with a reference transition time corresponding to the first reference slew rate.

6. The display device of claim 1, wherein the data driver further includes:

a second output buffer electrically connected to a second data line of the data lines, the second output buffer outputting a second data signal to the second data line; and a multiplexer that selectively transfers an output of the output terminal of the first output buffer and an output of an output terminal of the second output buffer to the first comparator.

7. The display device of claim 6, wherein, in a first period, the multiplexer transfers the output of the output terminal of the first output buffer to the first comparator, and the first comparator outputs a first comparison result corresponding to a first resistance between the first output buffer and the first data line, and in a second period, the multiplexer transfers the output of the output terminal of the second output buffer to the first comparator, and the first comparator outputs a second comparison result corresponding to a second resistance between the second output buffer and the second data line.

8. The display device of claim 1, wherein the data driver further includes:

a second output buffer electrically connected to a second data line of the data lines, the second output buffer outputting a second data signal to the second data line;

a second comparator; and a multiplexer that transfers an output of the output terminal of the first output buffer to the first comparator, and transfers an output of the second output buffer to the second comparator, and wherein the second comparator compares a second slew rate of the second data signal with a second reference slew rate.

9. The display device of claim 8, wherein the second reference slew rate is different from the first reference slew rate.

10. The display device of claim 8, wherein the data driver further includes:

a third output buffer electrically connected to a third data line of the data lines, the third output buffer outputting a third data signal to the third data line;

a fourth output buffer electrically connected to a fourth data line of the data lines, the fourth output buffer outputting a fourth data signal to the fourth data line; and a switching part that electrically connects the first output buffer or the third output buffer to the multiplexer, and electrically connects the second output buffer or the fourth output buffer to the multiplexer.

11. The display device of claim 10, wherein with respect to one or more pixels in a same row among the pixels, a first output timing at which the first output buffer outputs the first data signal is equal to a second output timing at which the second output buffer outputs the second data signal, and a third output timing at which the third output buffer outputs the third data signal is different from the first output timing of the first output buffer.

12. A display device comprising:

a display panel including:

data lines; and pixels electrically connected to the data lines; and a data driver that supplies data signals to the data lines, wherein the data driver includes a plurality of data driver ICs (integrated circuits), and each of the plurality of data driver ICs includes:

output buffers, each of the output buffers outputting a data signal to a corresponding data line among the data lines;

a comparator that compares a slew rate of a signal provided to an input terminal thereof with a reference slew rate; and a multiplexer electrically connected between the output buffers and the comparator, the multiplexer sequentially providing data signals output from the output buffers to the comparator;

wherein the reference slew rate is based on a contact resistance between the data driver and one or more of the data lines.

13. The display device of claim 12, further comprising:

a timing controller electrically connected to the plurality of data driver ICs through a feedback line, wherein the comparator generates a feedback signal by comparing the slew rate of the signal with the reference slew rate, and the plurality of data driver ICs sequentially provide the feedback signal to the timing controller through the feedback line.

14. The display device of claim 13, wherein the slew rate is changed according to a resistance of a contact resistor between an output buffer outputting the signal among the output buffers and a corresponding data line among the data lines.

15. The display device of claim 14, wherein the timing controller determines whether the resistance of each of the data lines is within a normal range based on a time at which the feedback signal is received.

16. A data driver comprising:

a digital-analog converter that generates a first data signal corresponding to grayscale values of image data;

a first output buffer that outputs the first data signal to the outside; and a first comparator electrically connected to an output terminal of the first output buffer, the first comparator comparing a first slew rate of the first data signal with a first reference slew rate;

wherein the first reference slew rate is based on a contact resistance between the data driver and one or more data lines.

17. The data driver of claim 16, wherein the first data signal is a square wave having a first voltage level or a second voltage level, and the first comparator determines a transition time from the first voltage level to the second voltage level as the first slew rate of the first data signal.

18. The data driver of claim 17, wherein the first comparator includes:

a first counter that calculates the transition time based on a reference clock signal; and a digital comparator that compares an output of the first counter with a reference transition time corresponding to the first reference slew rate.

19. The data driver of claim 16, wherein the data driver further includes:

a second output buffer that outputs a second data signal generated by the digital-analog converter to the outside; and a multiplexer that selectively transfers an output of the output terminal of the first output buffer and an output of an output terminal of the second output buffer to the first comparator.

20. The data driver of claim 19, wherein in a first period, the multiplexer transfers an output of the output terminal of the first output buffer to the first comparator, and the first comparator outputs a first comparison result corresponding to the first output buffer, and in a second period, the multiplexer transfers an output of the output terminal of the second output buffer to the first comparator, and the first comparator outputs a second comparison result corresponding to the second output buffer.

* * * * *